United States Patent [19]

Goldstein et al.

[11] Patent Number: 4,793,799

[45] Date of Patent: Dec. 27, 1988

[54] PHOTOVOLTAIC CONTROL SYSTEM

[75] Inventors: Mark K. Goldstein, La Jolla; Earl M. Dolnick, Encinitas, both of Calif.

[73] Assignee: Quantum Group, Inc., San Diego, Calif.

[21] Appl. No.: 48,961

[22] Filed: May 11, 1987

Related U.S. Application Data

[63] Continuation of Ser. No. 659,074, Oct. 5, 1984, abandoned, which is a continuation-in-part of Ser. No. 517,699, Jul. 25, 1983, abandoned.

[30] Foreign Application Priority Data

Jul. 3, 1984 [WO] PCT Int'l Appl. ..... PCT/US84/01038

[51] Int. Cl.[4] ..... F23N 5/08

[52] U.S. Cl. ..... 431/79; 431/12

[58] Field of Search ..... 431/2, 7, 12, 78, 79, 431/268, 326, 328, 51, 53, 90, 281, 329; 340/577, 570; 250/363 R, 364, 368, 369, 379, 393, 554; 361/173, 175, 176

[56] References Cited

U.S. PATENT DOCUMENTS

| | | | |
|---|---|---|---|
| 2,306,073 | 12/1942 | Metcalf | 431/79 X |
| 3,037,554 | 6/1962 | Risse | 431/268 X |
| 3,046,406 | 7/1962 | Dietiker | 431/79 X |
| 3,188,836 | 6/1965 | Kniebes . | |
| 3,537,804 | 11/1970 | Walbridge | 431/79 X |
| 3,765,820 | 10/1973 | Ito et al. | 431/79 X |
| 3,820,097 | 6/1974 | Larson . | |
| 3,943,705 | 3/1976 | De Corso et al. | 431/268 X |
| 4,043,934 | 8/1977 | Shuler et al. . | |
| 4,370,557 | 1/1983 | Axmark et al. | 431/79 X |
| 4,415,264 | 11/1983 | Wittmer | 431/79 X |
| 4,584,426 | 4/1986 | Nelson | 431/100 X |

FOREIGN PATENT DOCUMENTS

| | | | |
|---|---|---|---|
| 0120203 | 1/1984 | European Pat. Off. . | |
| 0101086 | 2/1984 | European Pat. Off. . | |
| 0139434 | 3/1984 | European Pat. Off. . | |
| 690479 | 4/1940 | Fed. Rep. of Germany . | |
| 1189734 | 11/1965 | Fed. Rep. of Germany . | |
| 2152384 | 4/1973 | Fed. Rep. of Germany . | |
| 2518264 | 4/1976 | Fed. Rep. of Germany . | |
| 3203477 | 11/1983 | Fed. Rep. of Germany . | |
| 2235609 | 6/1973 | France . | |
| 2356883 | 1/1978 | France | 431/79 |

OTHER PUBLICATIONS

Guazzoni, High Temperature Spectral Emittance of Oxides of Erbium, Samarium, Neodymium and Ytterbium, Jun. 18, 197 *Applied Spectroscopy*, pp. 60 to 65.

*Primary Examiner*—Randall L. Green

*Attorney, Agent, or Firm*—Christie, Parker & Hale

[57] ABSTRACT

An apparatus (1) is disclosed for controlling oxidation of a fuel in an oxidation source (2,3). The apparatus includes photovoltaic means (5) for receiving electromagnetic radiation (6) from the oxidation source and for producing electric power having a given electric power magnitude. An oxidation control (8, 1A, 1B, 288, 325) is coupled to, and driven, by, the photovoltaic means for controlling the oxidation. The oxidation is adjusted when the electric power is less than the given electric power magnitude. Oxidation may also be adjusted when a hazardous gas is detected. The apparatus (1A) may be used to power various electronic circuits. The apparatus (1B) may also be used to maintain the efficiency of the combustion source. A novel arrangement (248) for operating a fuel control valve is also disclosed. An apparatus (418) for controlling a portable heater is also disclosed.

25 Claims, 10 Drawing Sheets

PHOTOVOLTAIC CONTROL SYSTEM

CROSS-REFERENCE TO RELATED APPLICATIONS:

This application is a continuation of U.S. patent application Ser. No. 659,074, filed Oct. 5, 1984, now abandoned, which was a National Application corresponding to International Application PCT/US84/01038, filed July 3, 1984, which was a continuation-in-part claiming priority of our U.S. patent application Ser. No. 517,699, filed July 25, 1983, now abandoned.

TECHNICAL FIELD

The present invention relates to control and safety devices for fuel oxidation devices, and more specifically to photovoltaic control systems for combustion appliances.

BACKGROUND ART

In 1899, F. Robertshaw invented a thermostat gas control system for home hot water heaters. With the invention of the thermocouple and its use in operating electromagnetic fuel control valves, such as is shown in Mantz, U.S. Pat. No. 2,351,277, the safety of these gas control systems was enhanced. However, no major conceptual improvements in low cost valve controls have occurred since that time. Thermocouple/thermopile controls produce very low voltage and are unable to provide the power in the form of potential and current (particularly voltage) required to operate modern semiconductors or other simple electronic circuits used to control combustion appliances. Thermocouples have a relatively slow response time. Additionally, it would be useful to be able to detect carbon monoxide for controlling the combustion device because hazardous concentrations of carbon monoxide are often produced before any other malfunction can be detected.

In many countries, unvented gas heaters are not approved for home use without an added safety device such as a safety shutoff valve actuated by an oxygen depletion sensor (ODS). The ODS determines when low levels of oxygen occur and shuts off the combustion source. When the oxygen concentration decreases, the unstable pilot flame jumps off the pilot orifice, causing the thermocouple to cool. Another type of thermocouple control, classified as an oxygen depletion sensor, is described in Great Britain Patent No. 992,102 to Societe Gama. The oxygen depletion sensor suffers the same deficiencies as the other thermocouple controls. None of the thermocouple controls can sense the presence of carbon monoxide, which often reach dangerous levels before significant depletion of oxygen. The ODS suffers from premature shutoff and inability to detect deadly CO.

Other control systems typically require external power sources or provide complex circuitry for accomplishing control. Such systems include flame rectifiers, photocell systems, spectroscopic analyzers, and oxygen sensors. These systems will now be discussed.

Flame rectifiers such as that shown in Smith et al., U.S. Pat. No. 2,748,846, have been used for obtaining faster response to flame-out (loss of flame), but these systems are expensive, require external power and often have slower response times. Serber, U.S. Pat. No. 4,405,299, also shows such a device.

Smith et al. also teaches the use of a lead sulfide photoconductive cell 13 for sensing flame emitted from a burner. Bogdanowski et al., U.S. Pat. No. 2,835,886, shows the use of a photocell 24 in conjunction with an external power source for indicating the decrease in concentration of oxygen in an area surrounding the flame. Other devices using photocells in combination with external power sources are shown in Westbrook, U.S. Pat. Nos. 2,898,981, Pounds; 3,086,147, Giuffrida; 3,238,423; Sellors, Jr., 3,576,556; and Guilitz, 4,059,385.

Miller, U.S. Pat. No. 3,102,257, shows a device utilizing a filter for eliminating all visible light, except that of wavelengths absorbed by carbon monoxide or other gas which absorbs visible light having the wavelength of the transmitted light. The photocell used for detecting the particular band passed by the filter is used in combination with an external power source.

Other control systems for modern gas appliances utilize flame color monitors for monitoring the gas flame. In the late 1960's, Briggs, U.S. Pat. No. 3,301,308, and Alexander et al., U.S. Pat. No. 3,304,989, provided a safety control for portable heaters and like equipment with a fuel feed control system responsive to the color of a flame. Both of these systems use cadmium sulfide cells to increase combustion appliance safety. These systems are complex and expensive, requiring external power sources, but are still unreliable.

In United Kingdom Patent No. 2,052,725, an oxygen sensor is utilized to control burning efficiency through the monitoring of the oxygen concentration of the burner exhaust gases. The oxygen concentration is used to regulate the air-fuel ratio. The control is a complex device requiring outside power, is expensive, is not fail-safe, and is ineffective in controlling combustion when hazardous amounts of carbon monoxide are present.

Carbon monoxide (CO) is often present as a by-product of combustion. It can accumulate to harmful levels when gas appliances or other combustion devices malfunction or are used without adequate ventilation. The risks due to the presence of CO have increased in recent years due to energy conservation measures, which reduce air exchange, or substitute zone heating for central heating.

A low-cost CO sensor would greatly increase the safety of gas heaters. The use of unvented gas appliances, such as ranges and clothes dryers, is also hazardous because of CO production and would benefit from the use of a CO sensor. However, most instruments presently used for detection of CO are not suitable for widespread use, such as on gas appliances and heaters, or in portable instruments for the home, auto or workplace.

Several devices for measuring carbon monoxide or carbon dioxide are described below.

Yant et al., U.S. Pat. No. 2,531,592, teaches a device for detecting carbon monoxide or other gases through use of a catalyst coated on a thermopile. Yant et al. suffers from the same defects as do the devices utilizing thermocouples or thermopiles for otherwise controlling combustion devices.

Klug, U.S. Pat. Nos. 2,549,974 and 2,561,802, and Farr et al., U.S. Pat. No. 2,553,179, use the photocharacteristic change of a substance to detect carbon monoxide. The device uses a complex electronic bridge circuit, along with the National Bureau of Standards colorimetric indication gel invented by Martin Shepherd, as a detector. However, the photocharacteristic change of the indication gel is reversible only by the flushing of the gel with a particular regenerating gas. As a result, ambient carbon monoxide would eventually trigger an alarm due to buildup of CO over time, requiring that the indicator be changed periodically to prevent false alarms due to accumulated CO. Furthermore, the device requires an external power source. Such control systems are large and expensive and not suitable for gas appliances or other mass market applications.

Gafford et al., U.S. Pat. No. 3,114,610, teaches a device for continuous gas analysis by measuring the change in pH caused by carbon dioxide as an indirect measure of carbon monoxide. Transmission of light from an external source to a photocell is changed due to the color change of a sensing gel containing a pH-sensitive dye. The change in the amount of light transmitted is detected with the photocell. Gafford et al. also requires an external power source and is subject to interference from smog and other gases.

Guenther, U.S. Pat. No. 3,754,867, teaches a chemical system which is reversibly absorbent for carbon dioxide, and includes a pH color-changing dye and a photocell. This system uses an outside power source for supplying power to the light source for producing a signal. The system would also be subject to nuisance shutoff and unreliability due to ubiquitous carbon dioxide. The applicability of the device for measuring sulfur dioxide and other gaseous acidic anhydrides is mentioned in Guenther.

There is a need for a control for combustion devices which is compact, does not require external power sources, and which is inexpensive to manufacture and use. There is also a need for more efficient controls for such devices than exist with thermocouple controls and similar devices having slow response times. Furthermore, it is desirable to provide a control which operates with a quantum device having an abrupt cutoff, rather than linearly or gradually as a thermocouple does. In this regard, it would be desirable to provide a spectral source to aid in the detection of toxic or volatile gases. The present invention overcomes the technological and economic disadvantages of previous devices, and offers a safe, efficient, convenient and self-sufficient control for combustion devices.

DISCLOSURE OF THE INVENTION

There is disclosed an apparatus for controlling oxidation of a fuel in an oxidation source. The apparatus includes photovoltaic means for receiving electromagnetic radiation or photon emissions from the oxidation source for producing electric power having a given electric power magnitude comprising electric potential and current components. A fuel control is coupled to, and driven by, the photovoltaic means for regulating the oxidation. The apparatus terminates the oxidation, stops the supply of fuel, or provides warning when the electric power is less than the given electric power magnitude, e.g., when the oxidation in the form of combustion or flame is extinguished or when other hazards are detected. The apparatus thereby prevents emission of toxic and/or combustible gases.

The photovoltaic regulating means portion of the apparatus produces current and potential to form electric power by direct conversion of radiant energy and is capable of a variety of important functions which heretofore have been performed only by externally- or battery-powered control systems. The photovoltaic means, through the photon emissions, may be used to power various instruments, such as those to control the flow of fuel, to provide electronic ignition, to recharge storage devices, to control exhaust gas emissions, to control an air-fuel mixture for energy efficiency and to provide power for warning devices. Photovoltaic cells provide a much shorter response time in the case of flame failure for shutting off the flow of fuel than do thermocouples or thermopiles. The photovoltaic regulating means may also be used to provide fuel shutoff when dangerous levels of toxic combustion products and/or combustible gases are detected The electromagnetic radiation is produced by the heating of emissive means or spectral shift elements in the form of a black body radiator, such as a metal wire, or a luminescent thermally stimulated quantum emitter The emissive means is either placed adjacent the oxidation source or incorporated in the structure of the oxidation source. The emissive element is chosen so that it radiates light at a characteristic wavelength corresponding to the sensitivity of the photovoltaic cell(s), so that any change in the oxidation of the fuel will have a pronounced effect on the intensity and wavelength of the radiation and therefore on the potential and current produced by the photovoltaic cell(s). Alternatively, the emissive element is chosen so that it radiates at a characteristic wavelength corresponding to the sensitivity of a hazardous gas sensor. As a result, a more rapid response can be provided for shutoff of fuel than can be had with other self-powered devices, and a more reliable response can be had than with flame detectors operated through a battery or other external power sources.

A toxic or combustible gas sensor can be provided in the present invention so that an increase in the toxic and/or combustible gas concentration would also regulate fuel oxidation in parallel with regulation by radiation from the emissive means. Gases, such as carbon monoxide, the nitrogen oxides, and other gases, can be detected and dose exposures produced by their concentrations over time used to initiate closure of the fuel control. Such a system allows significant improvements in response time and accuracy in controlling fuel oxidation as a function of the concentration of toxic and/or combustible gases.

One of the unique features of this invention is the fact that it is portable. No batter or outside power source is required, thereby providing a more reliable and more fail-safe device. The photovoltaic-powered valve is operated entirely from the power produced by the flame, i.e., the radiation from the emissive means heated by the flame. To accomplish this, an infrared and/or visible radiation-sensitive photovoltaic cell may be employed. The use of photovoltaic cells sensitive to visible light can be used with a thermally stimulated quantum emitter material placed within the flame, such as a mantle similar to those used in portable propane or gasoline lanterns containing thorium oxide and cerium oxide as the active emitter, and magnesium oxide as a binder. However, most photovoltaic cells provide a maximum response in tee near infrared and therefore a mixture of oxides o holmium, erbium, and other lanthanide and actinide elements are preferred as they produce narrow wavelength bands of light in the red and/or near infrared. The lanthanide elements may be specifically chosen for producing light in the region of the spectra where the toxic gas sensor absorbs greatest. For example, a carbon monoxide sensor known as the Shuler/Schrauzer gel absorbs greatest in the regions of 675 nm and 890 nm. Therefore, C safety applications of the present invention might employ one section of the emitter for emitting in the 675 nm or 890 nm regions while another section of the emitter may be constructed of lanthanide oxides or other chemicals that emit in other narrow regions of the spectrum.

A quartz or silicon dioxide fiber or high concentration silicon dioxide glass fiber or filament may be used as both an emissive means and light pipe filter to carry large amounts of light of the appropriate wavelength to the CO or other gas-sensitive means. The in-flame portion of this (high) silicon dioxide fiber may be coated with thermally stimulated quantum emitters discussed above.

The apparatus can be used not only with gas appliances but also with liquid and solid fuel combustion appliances. The apparatus may also be used as a convenient emitter of light of a known frequency, i.e., in specific spectral regions, for camping, emergency use, and other viewing and spectroscopic detection purposes.

MODES FOR CARRYING OUT THE INVENTION

Figure 1:
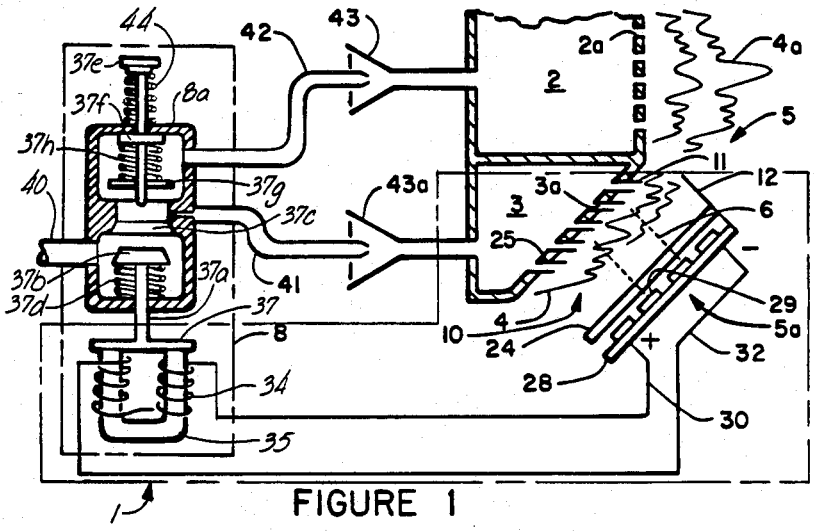
FIG. 1 is a schematic diagram of a combustion device having a fuel flow control valve operated by a photovoltaic sensor.

In FIG. 1, a photovoltaic safety control system 1 for controlling oxidation of a fuel or combustion of an oxidation source includes a photovoltaic control system 5. The photovoltaic control system 5 includes photovoltaic means **5*a* for receiving electromagnetic radiation, in the form of infrared, ultraviolet, or visible radiation 6 from the oxidation source in the form of main burner 2 and pilot burner 3. The photovoltaic means 5*a*** is adapted for producing electric power having a predetermined electric power magnitude (not shown).

The photovoltaic safety control system 1 also includes a fuel control in the form of magnetically latched valve 8 coupled to, and driven by, the photovoltaic means **5*a* for regulating the combustion in the form of flames 4 and 4*a* in the pilot burner 3** and the main burner 2, respectively. Tee safety control system 1 is adapted such that the combustion is terminated when the electric power is less than the predetermined electric power magnitude.

It will be understood that the description herein includes a description of the method for utilizing the apparatus described.

Referring to the schematic of FIG. 1 in more detail, a combustion apparatus is provided comprising the photovoltaic safety control system 1, main burner 2, and latched valve 8. The main burner 2 produces flame 4*a* through ports 2*a* for producing heat, flame, or light. Main burner 2 is provided with fuel (not shown) through pipe 42 and through means for combining the fuel with oxygen-containing gas and for regulating a gas-fuel mixture in the form of air-fuel mix chamber 43 for combustion. The pilot burner 3 in the control system 1 is similarly provided with ports 3*a* for producing flame 4 for providing a standard flame or light. The pilot burner 3 is provided with fuel through a pipe 41 and pilot air-fuel mix chamber 43*a*.

The magnetically latched valve 8 is provided for regulating the supply of fuel to the air-fuel mix chambers and for regulating combustion. Valve 8 may include any magnetically or electrically controllable control mechanism presently known that employs a magnetic safety latch mechanism, adapted for use with the apparatus after suitable modification to the coil windings. Because of the increased voltage (potential) available through use of the photovoltaic means 5*a*, a variety of new valves may be designed and constructed using a variety of electronic components. Preferably, the valve is held open when the apparatus is operating normally, and automatically closes in response to a restoring force, such as spring pressure when an abnormality in the operation of the combustion device occurs The latched valve 8 preferably further includes a fixed horseshoe pole piece 35, which during normal operation, holds the top pole piece 37 in the valve body 8*a* such that the flow channel between pipe 40 and pipes 41 and 42 is maintained and the valve 8 is in an open position, as shown in FIG. 1. The fixed horseshoe pole piece includes shutoff coil 34, which produces a magnetic field. The characteristics of the coil are described in more detail with respect to FIG. 30. The windings of coil 34 are such that the top pole piece 37 is preferably held against the fixed horseshoe pole piece 35 when a potential and current developed in the photovoltaic means 5*a* is applied to coil 34 for holding valve 8 open. The valve 8 is generally constructed so that the flow of fuel through pipe 40 to the main burner 2 cannot continue unless the magnetic latch or top pole piece is maintained at the horseshoe pole piece 35 by the power produced from the photovoltaic means 5*a*.

Valve 8 is provided with a top pole piece 37 comprising a first stem 37*a* coupled to the top pole piece 37. The first stem 37*a* is journaled through a valve body 8*a* and terminates in a valve tip 37*b*. The valve tip 37*b* is biased toward a valve seat 37*c* by a first spring 37*d*. Valve tip 37*b* and valve seat 37*c* operate to prevent flow of fuel into the burners. Opposite the stem 37*a* and valve tip 37*b* is a typical prime button 37*e* biased away from the valve body 8*a* through a second spring 44. The outward motion of the prime button 37*e* is limited by stop 37*f* on the interior of the valve body. Interior to the stop 37*f* is a butterfly valve 37*g* biased inwardly away from the side of the valve body by a third spring 37*h*. The structure, function and operation of the butterfly valve 37*g* is well known in the art.

The pole piece 35 and shutoff coil 34 are similar in design to those found in systems with thermocouple and thermopile controls, but have many more turns (not shown) to allow use with lower currents and higher voltages produced by photovoltaic means.

When combustion of an air-fuel mixture from chambers 43 and 43*a* occurs at burners 2 and 3, flame 4 and 4*a* is produced and electromagnetic radiation 6 is produced by the heat of combustion. In the preferred form, the photovoltaic means 5*a* is so placed as to be irradiated by radiation 6 from the pilot burner 3, but any configuration with respect to burners 2 and 3 suitable for controlling the combustion source is contemplated. Various arrangements are described herein.

The photovoltaic means 5*a* includes a photovoltaic array 28 of one or more individual photovoltaic cells 29. The individual photovoltaic cells 29 are coupled in series for producing potential and current for output from the photovoltaic array for controlling the shutoff coil 34. In an alternative form, the individual photovoltaic cells 29 may be coupled in parallel or in a combination of series connections and parallel connections in order to produce appropriate potential and current for controlling the shutoff coil 34. The output of the photovoltaic array 28 is coupled to the coil 34 through a positive conductor 30 and a negative conductor 32. The positive and negative conductors are coupled to the shutoff coil 34 in order to maintain the valve 8 for providing fuel to the mix chambers during normal operation as discussed above. The individual photovoltaic cells 29 are arranged and coupled in the array 28 as is well known in the art, as are conductors 30 and 32 and their couplings. The array 28 is preferably oriented with respect to the flame 4 of pilot burner 3 such that the individual photovoltaic cells 29 are irradiated by radiation from pilot burner 3. The minimum requirement with respect to location of the array 28 is that sufficient radiation must strike the individual photovoltaic cells 29 to produce the require current and potential at conductors 30 and 32 for controlling the magnetically latched valve 8. As will be described in more detail below, it may be desirable to drive other components with the potential and current produced by the array 28. A cover of transparent material, such as glass 24, may be provided over the individual photovoltaic cells 29, between cells 29 and the pilot burner 3, for preventing overheating of the photovoltaic array.

The array 28 comprising the individual photovoltaic cells 29 is preferably composed of any well known photovoltaic material, such as amorphous thin film, single crystal, or polycrystalline silicon, cadmium telluride, mercury cadmium telluride, indium cadmium arsenide or copper indium diselenide. Alternatively, a layered semiconductor can be used, for example silicon and indium gallium arsenide or silicon and indium diselenide For example, a silicon photovoltaic cell will produce a current with a voltage of approximately 0.45 volts. This is sufficient to control the valve 8. Other electronic circuits described below may be incorporated into the combustion device, e.g. an alarm. Most typical silicon semiconductor circuits require voltages greater than 1 volt. Therefore, several photovoltaic cells are connected in series to obtain the proper operating voltage for controlling valve 8. Additional photovoltaic cells would be provided where other electronic circuits are incorporated into the combustion device.

The number of series-connected photovoltaic cells required to drive the various elements will depend on the number of circuit element and the specifications of the combustion source.

The photovoltaic cells 29 preferably produce a potential and current upon irradiation by infrared, visible, or ultraviolet radiation 6, but cease to produce such potential and current when the radiation ceases and when only longer wavelength radiation is incident on the array 28. For example, if silicon photovoltaic cells are used, the response curve for such silicon cells peaks at about 900 nanometers and falls off rapidly at 1100 nanometers. Therefore, it is desirable to have radiation 6 produced during normal combustion in the wavelength region of about 900 nanometers in an amount sufficient to control the control valve. The radiation is preferably below 1100 nanometers. Furthermore, a photovoltaic cell operating in the wavelength region between 900–1100 nanometers would be relatively insensitive to black body radiation from the surrounding elements in the combustion device, which is commonly of a longer wavelength.

The sensitivity of the photovoltaic cells is shown by noting that the quantum band gap in solid state devices has a defined and sharp threshold. The power output of a photovoltaic cell falls off abruptly over time and not linearly or continuously as does a thermocouple, where radiation in the optimum response region ceases. Therefore, when stimulation of the solid state device at the characteristic wavelength is eliminated, the operation of the solid state device is changed abruptly. The band gap of the solid state device may be tailored by doping the device with selected impurities, known in the art to maximize the pertinent functional characteristic. With the photovoltaic cells, for example, the device can be modified to operate optimally in the near infrared spectrum. The band gap selected for the particular device thereby defines the response region for the particular device.

The photovoltaic control system 5 includes an emissive element 11 placed in the combustion area in the flame 4 for emitting radiation of a characteristic wavelength. The emissive element 11 is heated to incandescence (for black body radiation) or luminescence (for thermally stimulated quantum radiation). Silicon dioxide is one example of an emissive element and produces radiation having a characteristic wavelength near 900 nanometers upon being heated by flame 4 when used in conjunction with silicon photovoltaic cells. Holmium or erbium may be used as thermally stimulated quantum emitters if a wavelength of around 675 nanometers is desired from the emissive means. Furthermore, the emissive element is formed such that when flame 4 changes in such a way that a dangerous condition results, such as in a flame failure, the emission of radiation by the emissive means 11 of the characteristic wavelength changes very rapidly to indicate the flame change. For example, the emissive element is preferably formed of fine wire or refractory material which cools rapidly upon flame failure, so that radiation only of wavelengths longer than 1100 nanometers is emitted by the emissive element and received by the photovoltaic means. In such a case, the longer wavelength radiation is not converted by the photocell because the energy of the incident photon is less than that for which the photocell produces a potential and current. Therefore, background radiation from the surrounding furnace structure and longer wavelength radiation from the cooled emissive element does not significantly interfere with operation of the photovoltaic array except to the extent background radiation heats the photovoltaic cell, causing it to lose efficiency.

A benefit in using the thermally stimulated quantum emitters as the emissive element is that the radiation is emitted based on quantum changes in the orbital electrons. As a result, the effect of reducing the heat by which the emissive element is heated reduces the intensity of the emissions, but not the characteristic wavelengths thereof. The emissive element can then be selected when narrow band wavelengths are desired so that the emission spectra occurs in the near infrared, visible, or ultraviolet region and so that the peak wavelength of the emitted light does not vary as a function of flame temperature caused by variations in fuel, fuel pressure, and other environmental factors.

Figure 20:
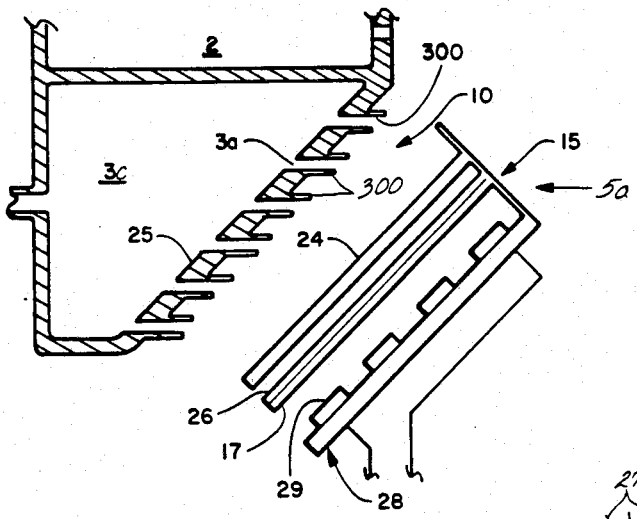
FIG. 20 is a schematic and partial side sectional view of a pilot burner with molded protruding fingers for producing characteristic wavelength electromagnetic radiation.

In one preferred embodiment, the ports **3*a* of the pilot burner 3 comprise the emissive element 11 embedded in or attached to the material of the pilot burner and in another embodiment the emissive element 11 is integral with the ports 3*a* (FIG. 20**).

Alternatively, radiation can be produced by the heat from catalytic oxidation (not shown) in which no flame is present.

In operation, the combustion device of FIG. 1 is started by holding the valve tip of latched valve 8 in an open position through the adjacent end of the butterfly valve **37*g* against biasing valve spring 44, thereby allowing the fuel, for example in the form of a gaseous hydrocarbon, to enter through pipe 40. The fuel enters valve body 8*a* and flows through pipe 41 and into the pilot air-fuel mix chamber 43*a*. The air-fuel mixture then flows to pilot burner 3 and is ignited by an ignition system, such as a piezoelectric ignition (not shown) or the ignition system to be described below with respect to FIG. 19. The emissive element 11 is heated to incandescence or luminescence for producing radiation. If sufficient radiation is produced to provide a potential and current in the photovoltaic array 28, the top pole piece 37 is held by magnet 35. The butterfly valve can then be set for producing flame 4*a*** in the main burner.

The initial heating of the emissive element 11 is accomplished over a short period of time, i.e., four seconds, to produce the infrared and visible radiation 6. The radiation is absorbed by the photovoltaic means **5*a* in the form of the individual photovoltaic cells 29. A portion of the radiation is converted to electric potential and current, or power, which is applied from the photovoltaic means through conductors 30 and 32 to the latched valve 8. The potential and current control the shutoff coil 34 to maintain the latched valve 8 in an open position during normal operation. In the usual manner, the magnetic field attracts the top pole piece 37 against the opposing bias of first spring 37*d* to maintain the flow of fuel through pipe 40. The pole piece 37 is maintained adjacent the surface of horseshoe pole piece 35**, thereby maintaining the valve in an open position as long as the emissive means produces sufficient radiation at the characteristic wavelength.

If the flame 4 were to be extinguished for any reason, or if the flame were to lift off ports **3*a* due to insufficiency of oxygen, the emissive element would quickly cool and the wavelength of radiation produced by the emissive element 11 would increase. Since the photovoltaic means 5*a* would be relatively insensitive to longer wavelengths, as described above, the potential and current output from the photovoltaic array would drop rapidly. As a result, the potential and current provided through conductors 30 and 32 would decrease, thereby causing a reduction in the electromagnetic field such that the top pole piece 37 leaves the surface of the horseshoe pole piece 35. The bias of first spring 37***d* would then force the valve tip 37*b* upward, as viewed in FIG. 1, thereby closing latched valve 8.

The above-described device can detect, among other things, loss of flame and incorrect air-fuel mixture causing flame lift-off, and can provide means for shutting off the supply of fuel in a relatively short time when such incomplete combustion occurs. The system is self-powered and fail-safe in that the system operates only when there is the required combustion. No external power sources are required since the photovoltaic cells and the coil 34 can be adapted for producing the potential and current required to operate the magnetically latched valve 8. Furthermore, the photovoltaic cells can be further adapted to operate additional electronics as described below. Because the system will automatically shut off when the radiation of the characteristic wavelength is interrupted or its intensity is reduced, the above-described device can be adapted or calibrated to terminate combustion at any time when the transmission of infrared, ultraviolet or visible radiation 6 is interrupted.

The reflector 12 may be provided adjacent the photovoltaic means 5*a* for reflecting or focusing any scattered characteristic wavelength radiation toward the photovoltaic array. The reflector 12 may consist of a converging or parabolic mirror (not shown) to collect and focus the characteristic wavelength radiation. Alternately, a lens (not shown) may be used.

Figure 2:
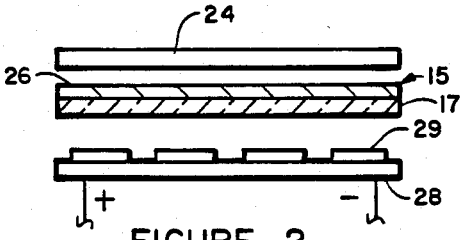
FIG. 2 is a schematic and side sectional view of a first alternative embodiment of the photovoltaic sensor of FIG. 1.

In one form of the invention there is provided a plate 15 between the emissive means 11 and the photovoltaic cell array 28 comprising means 17 sensitive to a first target gas in the form of toxic gases, such as carbon monoxide or acid gases. Means sensitive to combustible gases such as propane or other gases, such as any non-toxic volatile products placed in the fuel for detecting leaks, can also be used for the same purpose. The gas-sensitive means may be a thin film coated onto any transparent material, such as glass, quartz, or plastic windows or filters. The gas-sensitive means 17 is adapted for preventing receipt of the electromagnetic radiation 6 by the photovoltaic means 5*a* when the presence of the target gas reaches a given level. Specifically, FIG. 2 shows a transparent plate 15 which is stained, coated, or impregnated with the gas-sensitive means 17, for example, a CO-sensitive material. The transparent plate 15 is placed over the individual photovoltaic cells 29 so that the gas-sensitive means is interposed between the photovoltaic cells 29 and the emissive means. In the preferred form, the transparent plate 15 is placed between the array 28 and the cover glass 24 for keeping the gas-sensitive means from heating up. In one embodiment, the transparent plate 15 is silica-coated fotoform glass, a material which may contain up to 50,000 holes per square inch. The gas-sensitive means 17 can be replaced relatively easily without having to replace the photovoltaic array 28 and the cover glass 24 when the gas-sensitive means 17 is in the transparent plate 15.

An example of a CO sensor is that described in Shuler et al., U.S. Pat. No. 4,043,934. For present purposes, the radiation produced by the emissive means is in the infrared and visible region. The Shuler chemical compound is ordinarily transparent to radiation in the near infrared and visible region produced by the emissive element when the CO concentration is low. However, the Shuler chemical compound, in the presence of CO, undergoes a change altering the ability to absorb and reflect light in the infrared and visible region. With increasing CO concentrations, the amount of absorbed and reflected radiation in this region increases so that the intensity of radiation at the array 28 decreases. The change in quantity of light absorbed by the substance is proportional to the concentration of carbon monoxide present and can be used to calibrate the regulation of the fuel control to shut off the combustion device when hazardous concentrations of CO are present. Other steps may be taken such as closing the main fuel valve for the house or other building. The Shuler chemical compound is also beneficial because it can be regenerated.

Carbon monoxide is ordinarily a by-product of combustion. In many situations CO is produced in dangerous amounts, e.g., when the amount of oxygen being mixed with the fuel at the mix chambers 43 and 43*a* is decreased, the burner is dirty, or the flame temperature is reduced. The CO-sensitive coating, which is normally transparent to light in the infrared and visible region, absorbs carbon monoxide and absorbs and/or reflects the incident radiation of wavelength in the infrared and visible region. The potential and current produced at the array 28 of photovoltaic cells concurrently drops off significantly, thereby closing latched valve 8 as described above. As a result, the photovoltaic control system 5 has a response time for reacting to the presence of carbon monoxide or other selected target gases which is comparable to the response time of the photovoltaic means 5*a* without the CO-sensitive material when reacting to otherwise faulty combustion. Even when the emissive element 11 continues to produce infrared radiation, the level of carbon monoxide due to incomplete combustion or other reasons serves to eliminate the infrared and visible radiation incident on the photovoltaic means 5*a*, thereby quickly cutting off the power to latched valve 8.

In another embodiment, the transparent plate 15 may further comprise means 26 sensitive to a second target gas. The sensing means 26 may be a thin film of target gas-sensing material coated on one portion of the plate 15 so that the second target gas-sensitive means is located serially with respect to the CO-sensitive material in the path of radiation 6. The second layer operates in the same manner as the gas-sensitive means 17 for controlling the latched valve 8. The second layer would absorb sufficient radiation from the emissive means 11 at the appropriate wavelength upon exposure of the second layer to the specific target gas for which the second layer is sensitive to inhibit transmission of the radiation to the photovoltaic array 28. For example, the second layer may be means for sensing acid gases, such as hydrogen cyanide, hydrogen chloride, and nitrogen oxides, convertible to a nitrogen acid, and other gases which are convertible to strong acids. Other gases which may be sensed include gases such as hydrofluoric acid and the other hydrogen chlorine gases.

The acid gas-sensing material may be any material which changes its optical properties in the presence of an acid gas. See, for example, Guenther, U.S. Pat. No. 3,754,867. The acid gas-sensing material is partially transparent to the light 6 of the particular wavelength emitted by the emissive means 11 when no acid gases are present. However, the sensor material inhibits, by absorption, reflection, or otherwise, the transmission of light in a particular wavelength region of the spectra when one of the acid gases are present. Preferably, the sensor material absorbs light 6 most strongly at those wavelengths produced by the emissive means 11. The presence of more than one acid gas at any one time is cumulative so that the presence of two acid gases, each at half the concentration of one required to close the valve, leads to the same inhibition of light transmission. The effect of the presence of an acid gas will also be cumulative with the effects of CO.

The acid gas-sensing material includes a substrate, in the form of silica gel, alumina, or other substance chemically inert under the conditions of operation. The acid gas-sensing material is preferably a dye, such as methyl purple or methyl violet, which absorbs light in the red or near infrared region in the presence of strong acids. A more specific dye may be used in conjunction with the thermally stimulated quantum emitter emitting anywhere in the infrared, ultraviolet, or visible spectra. The dye absorbs a significant portion of the light 6 from the emissive element 11 when the acid is present above a predetermined dose. A buffer may be used to prevent indications due to ubiquitous sulfur dioxide and to assure reversibility of the color change. Alternatively, some substrates which rapidly desorb and adsorb acid gas depending on the concentration in the air may be used without a buffer.

The CO-sensitive material and the acid gas-sensing material can also be located in a parallel relationship with respect to each other, rather than serially. For example, a CO-sensor can be placed over one portion of the photovoltaic array and an acid gas sensor can be placed over another portion. Alternatively, several arrays of photovoltaic cells may be provided, each with a corresponding target gas-sensitive means.

Figure 3:
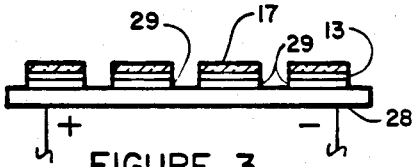
FIG. 3 is a schematic and side sectional view of a second alternative embodiment of the photovoltaic sensor of FIG., 1.

In FIG. 3, there is shown a further embodiment using a target gas-sensitive material such as the CO-sensitive material between the emissive pilot burner and the individual photovoltaic cells 29. The individual photovoltaic cells 29 may be in the form of rectangular parallelepiped blocks to be placed in an array for forming the photovoltaic cell array 28. A passive material such as a silica coating 13 is applied directly to the individual photovoltaic cells 29. The CO-sensitive material 17, separately or in combination with other target gas-sensitive materials, is then coated directly onto the thin silica layer 13. The substrate may also be fused silica, etched fused silica, quartz, etched quartz or high silica glass. The cover glass 24 may be placed as usual. This particular arrangement is low in cost and compact in size. The operation of the particular embodiment of the photovoltaic cell array 28 is similar to that described with respect to FIGS. 1 and 2.

Figure 4:
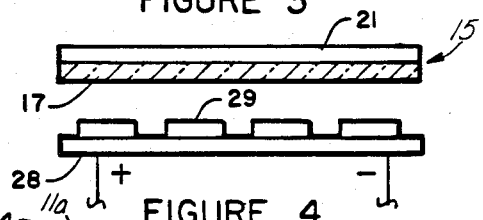
FIG. 4 is a schematic and side sectional view of a third embodiment of the photovoltaic sensor of FIG. 1.

A further embodiment similar to those of FIGS. 2 and 3 is shown in FIG. 4. There is provided a fused silica or quartz cover 21 disposed over the photovoltaic cells 29, between the photovoltaic cell array 28 and the flame 4. The lower side of the cover 21 is etched and coated with one or more of the target gas-sensitive materials, for example, a CO-sensitive material. The function and operation of the embodiment of FIG. 4 is similar to that described with respect to FIGS. 2 and 3.

Figure 5:
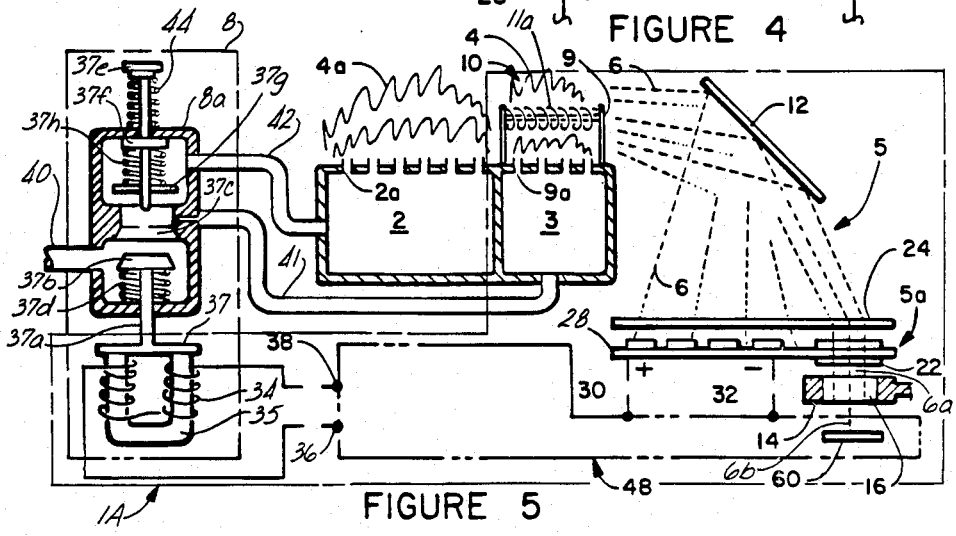
FIG. 5 is a schematic diagram of a second embodiment of a combustion device having a fuel flow control valve operated through an electronic circuit by a photovoltaic sensor and a combustion product sensor.

In FIG. 5, there is shown a second embodiment of a photovoltaic control system 5. The combustion apparatus of FIG. 5 is similar in structure, function, and operation to that shown in FIG. 1 except as noted below. Elements with identical structure, function, and operation to those of FIG. 1 are numbered identically therewith. The air-fuel mix chambers 43 and **43*a*** are omitted for clarity, but are assumed to be present in a combustion device.

The photovoltaic safety control system 1A includes emissive means 10 having an emissive element **11*a* in the form of a radiant coil supported by a radiant coil holder 9. The radiant coil holder 9 supports the emissive element 11*a* in the flame 4 of the pilot burner 3. The emissive element 11*a* produces infrared and visible radiation 6, which is reflected off of the reflector 12 to the photovoltaic means 5*a*. The reflector 12 and the photovoltaic means 5*a* are arranged with respect to each other and with respect to the burners 2 and 3 to provide adequate irradiation of the photovoltaic means 5*a* for producing power. The various emissive elements 11*a*** will be described in more detail below.

The photovoltaic safety control system 1A of FIG. 5 provides the photovoltaic array 28 in parallel with a target gas-sensitive material 16, for example, CO-sensitive material, for independently controlling the latched valve 8. The photovoltaic means **5*a* may include a filter 22 and/or 24 for restricting transmission of long wavelength light which causes heating of the photovoltaic array 28, to be described below, causing a reduction in the efficiency thereof. Filter 22 (optional) transmits radiation in the ear infrared and red visible radiation spectra from the emissive means 10** to enhance that spectral region. It also prevents the target gas-sensitive material from heating up.

The filter 22 is placed below the cover glass filter 24 opposite the infrared reflector 12. The filtered radiation **6*a* is then made incident on a target gas-sensitive material 16 retained in a holder 14, to be described further with respect to FIG. 13. The sensitive material 16 is similar to the sensitive material described above with respect to FIGS. 2–4. In the case of the CO-sensitive material, when the level of carbon monoxide is relatively low, the CO-sensitive material transmits a portion of the incident radiation to means for sensing transmitted light in the form of a light detector 60** for controlling the fuel supply as a function of the concentration of carbon monoxide.

The light detector 60 is adapted to be sensitive to the radiation being transmitted by filter 22 and by sensitive material 16. The light detector 60 is electrically coupled in an electrical or electromechanical circuit 48 for controlling the fuel control valve. The positive and negative conductors 30 and 32, respectively, of the photovoltaic cell array 28 are also electrically coupled to the control circuit 48 for independently controlling the latched valve 8. Output leads 36 and 38 of control circuit 48 are coupled to the shutoff coil 34.

During operation, fuel is supplied through pipe 40 to the burner 3. The flame 4 heats the emissive element 11 to incandescence or luminescence. The radiation 6 is reflected by reflector 12 to the photovoltaic means **5*a*. The radiation is transmitted through cover glass 24 to the individual photovoltaic cells 29 and to filter 22. The required potential and current for operating the magnetically latched valve 8 are provided through positive and negative conductors 30 and 32 of the photovoltaic array 28. Filter 22 transmits the selected band of light to the sensitive material 16, which transmits the filtered radiation to the light detector 60. The light detector 60 is coupled to the shutoff circuit 48** for maintaining the magnetically latched valve in an open position. The potential and current produced in the photovoltaic array 28 provides power to the shutoff circuit 48 which in turn provides power to the coil 34. When the flame 4 is extinguished or burned in an inefficient manner, the photovoltaic array output decreases to a point where the magnetically latched valve closes, as described above. In the case where the radiation emitted from the emissive means 10 falls outside the infrared and visible range of the filter 24, for example, due to inefficient burning or flame failure, the light transmitted by filter 24 decreases to a point where shutoff circuit 48 shuts off current and potential from the shutoff coil 34, thereby closing magnetically latched valve 8. In the case where the concentration of a target gas increases to dangerous levels, the filtered light transmitted by filter 22 is absorbed or reflected by the sensitive means 16, thereby decreasing the signal produced through light detector 60. As a result, the output to leads 36 and 38 of the shutoff coil 34 is decreased, in a manner to be described below, such that the shutoff coil 34 closes the magnetically latched valve 8.

In FIGS. 6–10, several shutoff or gate control circuits are shown for controlling combustion as a function of hazardous gas (e.g., CO) dose exposure. The circuits represent the control circuit 48 of FIG. 5.

Figure 6:
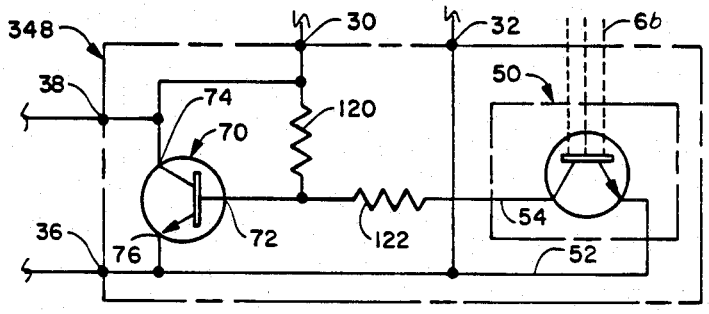
FIGS. 6–10 are schematic diagrams of embodiments of the circuit of FIG. 5 coupling the fuel valve and the sensors.

In FIG. 6, a shutoff circuit 348 is disclosed for short circuiting the current to the coil, wherein the positive and negative conductors 30 and 32 are coupled to the shutoff circuit 348. Incident radiation from the filter 22, or directly from the reflector 12 or emissive means 9, strikes an NPN phototransistor 50. The output terminals 36 and 38 of the shutoff circuit 348 are electrically coupled to the the shutoff coil 34 as described above.

The positive conductor 30 is coupled to a first side of a base current resistor 120 and also coupled to the collector 74 of an NPN coil shorting transistor 70. The second end of resistor 120 is coupled to the base 72 of transistor 70. The negative conductor 32 of the array 28 is coupled to the negative lead 36 of the shutoff coil 34. Similarly, the emitter 76 of the transistor 70 is coupled to the negative lead 36 of shutoff coil 34. The phototransistor 50 provides current in its collector-emitter circuit wherein the collector 54 is coupled to a first end of a resistor 22, the second end of which is coupled to the base 72 of transistor 70. The emitter of phototransistor 50 is coupled to the negative feed 36 of the shutoff coil 34.

The operation of circuit 348 is as follows: When the valve is operating normally, light from the emissive element strikes the large photovoltaic array 28, generating a current which flows through conductors 30, 32, 36, and 38 to coil 34. A potential then exists between the coil leads 36 and 38, which potential also appears across the collector 74 and emitter 76 of transistor 70. The transmitted light 6*b* striking the phototransistor 50 has already passed through the CO-sensing material 16 and through the associated optical components discussed with respect to FIG. 5. Current flowing to the base 72 of transistor 70 through resistor 120 causes transistor 70 to go into conduction. If sufficient light strikes transistor 50, the current through resistor 120 is drawn off through resistor 122 in order to keep transistor 70 in the off state. However, if a target gas, for example, carbon monoxide, is present, the light striking phototransistor 50 is reduced. As a result, the current drawn off of the base 72 of transistor 70 is reduced, causing transistor 70 to go into conduction if the reduction is below a predetermined level set by resistor 122. Current is then diverted from the positive conductor 30 through the collector-emitter circuit of transistor 70 to the negative conductor 32, and the valve closes since the current and potential in the shutoff coil 34 has decreased. The fuel supply is thereby shut off to the burner. As discussed with respect to the apparatus of FIG. 1, if there is insufficient light irradiating the photovoltaic array, the magnetically latched valve 8 will have insufficient potential and current applied to hold the valve open against the bias of spring 44. This also applies to the circuits to be discussed below with respect to FIGS. 7–10.

Figure 7:
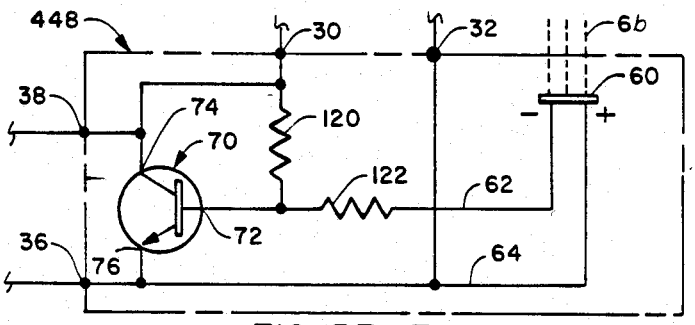

FIG. 7 shows a shutoff circuit 448 similar to that in FIG. 6, except for the substitution of a photovoltaic cell 60 for the phototransistor 50. The negative output 62 of the photovoltaic cell 60 is coupled to the first end of resistor 122 and the positive output 64 of photovoltaic cell 60 is coupled to the negative conductor 32 of the photovoltaic array 28. The balance of the circuit is essentially the same as that discussed with respect to FIG. 6.

In operation, transmitted light from the sensing material 16 illuminates the photovoltaic cell 60 producing potential and current in outputs 62 and 64. When sufficient radiation illuminates photovoltaic cell 60, the positive output through conductor 30 and resistor 120 is drawn off of transistor 70 through resistor 122 to the photovoltaic cell 60. Transistor 70 is thereby held in an off state when sufficient radiation illuminates photovoltaic cell 60. When the incident radiation decreases below a predetermined level determined by resistor 122, such current to the base 72 of transistor 60 from the positive output 30 of photovoltaic array 28 is not drawn off of transistor 70, and transistor 70 is thereby forced into conduction. The positive output of positive conductor 30 is thereby shunted through transistor 70 to the negative output of negative conductor 32 of the photovoltaic array 28.

Figure 8:
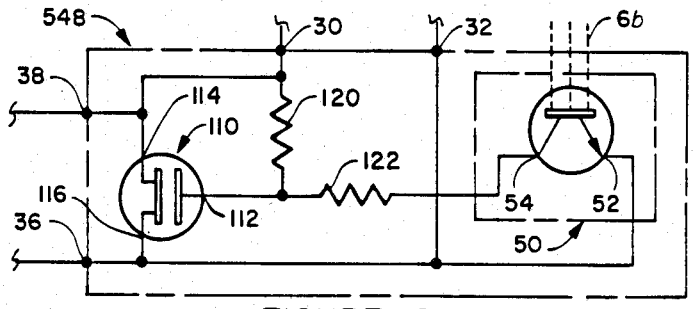

In FIG. 8, there is shown an alternative shutoff circuit 548 similar to the shutoff circuit 348 of FIG. 6. However, there is substituted an N-channel field effect transistor (FET) 110 for transistor 70. The positive output 30 is coupled to the drain 114 of FET 110, and the negative lead 32 is coupled to the source 116 of FET 110. The remainder of the shutoff circuit 548 is similar to that described with respect to FIG. 6. The operation of the shutoff circuit 548 is similar to that of shutoff circuit 348 except that, because gate 112 of FET 110 draws no current, the controlling parameter of the shutoff circuit 548 is the potential at gate 112 determined by the current drawn by phototransistor 50 through resistors 120 and 122. When the incident radiation on phototransistor 50 decreases, phototransistor 50 does not conduct, thereby increasing the potential at collector 54. The potential at gate 112 therefore increases and FET 110 conducts.

Figure 9:
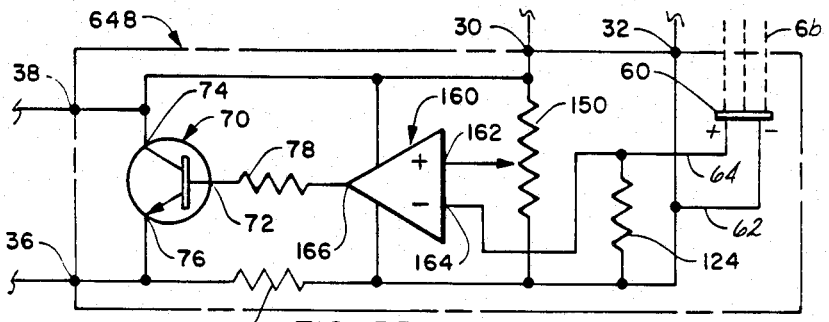

FIG. 9 shows a further embodiment of a shutoff circuit 648 utilizing a comparator circuit. The positive input 30 is coupled to one end of a potentiometer 150 and to the collector 74 of the NPN transistor 70. The negative conductor 32 is coupled to the negative lead 36 of the shutoff coil 34 through a current limiting resistor 100. Similarly, the emitter 76 of transistor 70 is coupled to the negative lead 36 of the shutoff coil 34. The second end of potentiometer 150 is coupled to the negative lead 36 of the shutoff coil 34. The wiper of potentiometer 150 is coupled to the positive-sensing input 162 of a comparator 160. The output 166 of comparator 160 is coupled through base resistor 78 to the base 72 of transistor 70. As with the shutoff circuit 448 of FIG. 7, transmitted radiation 6 irradiates photovoltaic cell 60, whose positive output 64 is coupled to the negative-sensing input 164 of comparator 160. The negative output 62 of photovoltaic cell 60 is coupled to the negative output 32 of the photovoltaic array and to the negative lead 36 of the shutoff coil 34. The negative output 60 and the positive output 64 of the photovoltaic cell 60 are bridged by a load resistor 124.

The comparator discriminates the combustion product concentration levels. Potentiometer 150 forms a voltage divider for sampling the voltage across shutoff coil 34. The sample is applied to the positive-sensing input 162 of comparator 160. Load resistor 124 samples the current produced by the photovoltaic sensor 60 which sample is applied to the negative-sensing input 164 of comparator 160. The potentiometer is adjusted and the load resistor is chosen so that under normal conditions of low levels of carbon monoxide, or other target gas, the voltage at the negative-sensing input 164 is greater than the voltage at the positive-sensing input 162 of comparator 160. As a result, the output 166 of comparator 160 is held in the low state and, therefore, the transistor 70 is nonconductive. Similarly, potential and current is thereby placed across leads 36 and 38 of shutoff coil 34. If carbon monoxide, or any other target gas, is present in a sufficiently high concentration for a sufficient time, the light striking photovoltaic cell 60 decreases and the current output of photovoltaic cell will likewise decrease. If the decrease is sufficient to allow the potential at the negative-sensing input 164 to drop below that of the positive-sensing input 162 of comparator 160, the output 166 will enter the high state which will send current through resistor 78 to base 72 of transistor 70 causing transistor 70 to go into conduction. As a result, the potential and current applied across shutoff coil 34 is decreased and magnetically latched valve 8 is closed.

Figure 10:
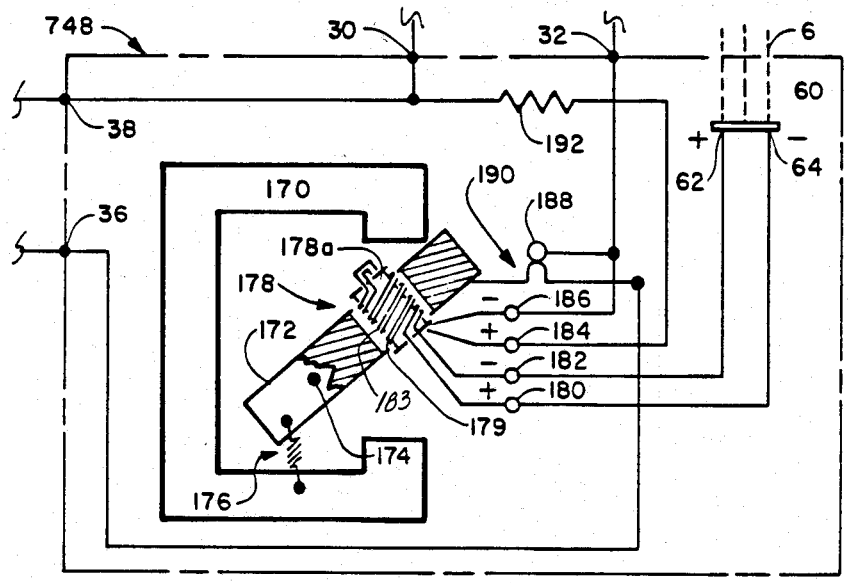

An additional embodiment of the cutoff circuit 48 is shown in FIG. 10, with respect to cutoff circuit 748. The cutoff circuit 748 contains an electromechanical switch for cutting off the potential and current to the cutoff coil 34. The cutoff circuit 748 is provided with a permanent magnet pole piece 170 shaped substantially as a "C". Between the open ends of the pole piece 170 is placed an armature 172 having one end interior to the pole piece 170 and coupled to the bottom thereof through an armature spring 176. The other end of armature 172 extends upwardly, as seen in FIG. 10 and outside of the interior portion of pole piece 170 and pivots about a mid portion of the armature 172 at an armature fulcrum point 174. The armature 172 is provided with bifilar wound coils 178 wound about a spool 178*a*. The bifilar wound coil 178 consists of two windings, one winding 179 with connecting wires 180 and 182 and the other winding 183 with connecting wires 184 and 186.

The transmitted radiation 6 falls upon a photovoltaic cell 60 for producing potential and current at positive output 62 and negative output 64. The negative output 64 is coupled to positive conductor 180 of a first winding 179 for the bifilar wound coils 178. The positive output 62 is coupled to the negative conductor 182 of the first winding 179. The positive output 30 of the photovoltaic array 28 is coupled to the positive lead 38 of the cutoff coil 34 and through adjusting resistor 192 to the positive conductor 184 in the second winding 183 of the bifilar wound coils 178. The negative output 32 of the photovoltaic array 28 is coupled to the negative conductor 186 of the second winding 183 and to a fixed switch contact 188. The opposite contact of fixed switch contact 188 is movable switch contact 190 which is mechanically coupled to the end of armature 172 extending out of the interior portion of pole piece 70. The movable switch contact 190 is coupled to the negative lead 36 of the cutoff coil 34. The armature 172 is held biased one way by the spring 176. The free end of armature 172 presses against the movable switch element 190, which together with fixed contact 188 provides a conduction path for the current flowing between photovoltaic array 28 and the safety shutoff coil 34.

Under normal conditions, adjustable resistor 192 is adjusted so that the magnitude of the current in windings 179 and 183 are equal. Since the currents flow in opposite directions, there is no net magnetic field. If carbon monoxide is present, the output of photovoltaic cell 60 will decrease as described above. The current in winding 179 will be therefore less than the current in winding 183 resulting in a net magnetic field being generated by the difference in current. The current flow is arranged so that magnetic field produced thereby is in opposition to the magnetic field of the permanent magnet. This results in a torque being applied to coil 178. Because coil 18 is rigidly attached to armature 172, the latter being free to move about fulcrum point 174, the armature 172 rotates about the fulcrum point in response to the generated magnetic field. In so doing, the outside end of armature 172 presses against the movable switch element 190 causing it to break contact with the stationary switch element 188. As a result, the circuit to cutoff coil 134 is opened, causing magnetic latched valve 8 to close.

Figure 11:
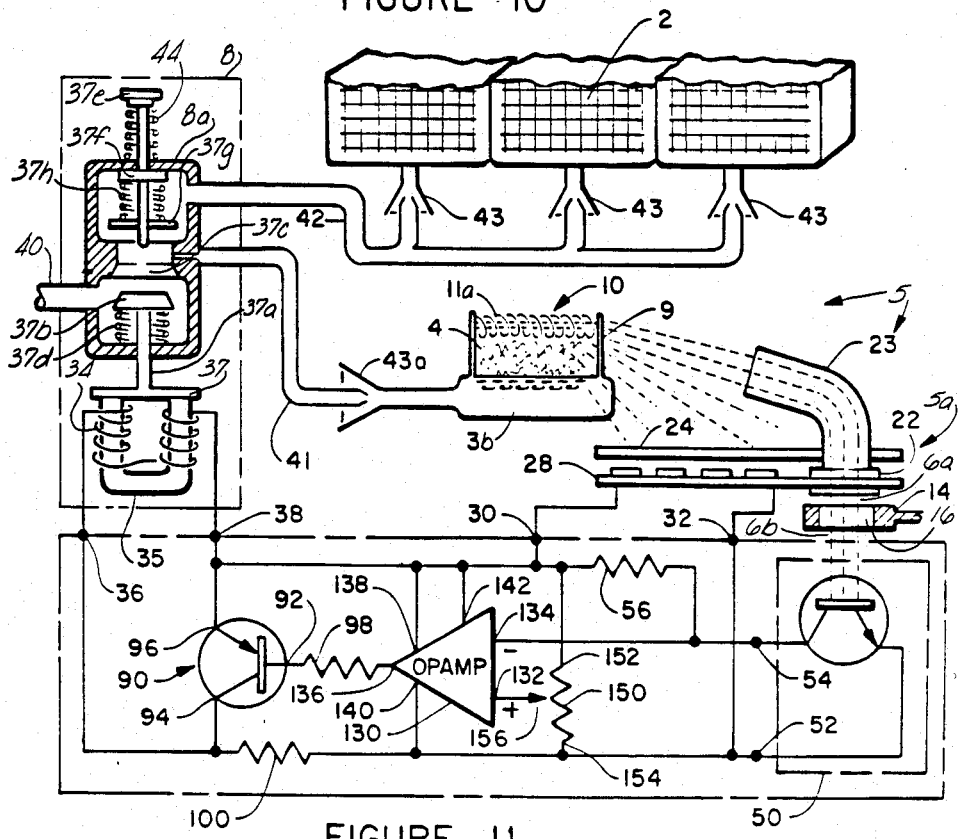
FIG. 11 is a schematic diagram of a third embodiment of a combustion device including a fuel flow control valve and photoelectric and combustion product sensors in combination with a light guide.

A third embodiment of the combustion apparatus and photovoltaic control system is shown in FIG. 11. A fuel supply pipe 40 is shown for feeding fuel through a valve body 8*a*. A magnetically latched valve 8 provides means for regulating the supply of gas to the combustion apparatus. A pipe 41 transfers fuel from the valve 8*b* to a pilot burner 3*b* through a pilot air-fuel mix chamber 43*a*. A pipe 42 conveys fuel to a series of air-fuel mix chambers 43 providing air-fuel mixture to main burners 2.

Emissive means 10 for producing radiation of a characteristic wavelength includes an emissive element 11*a* supported by a radiant coil holder 9. Other elements common to the devices shown in FIGS. 1 and 5 are given common reference numerals and have structures and functions similar to those of the common elements of FIGS. 1 and 5. Other elements will now be described.

The radiation from the emissive means 10 falls on the cover glass 24 of the photovoltaic means 5*a*. The filter 22 is provided in the photovoltaic means 5*a* as is a target gas-sensitive material 16 and holder 14, each having structures and functions comparable to similar elements in the above-described apparatus. Radiation is transmitted from the emissive means 10 through a fiber optic bundle or single optical fiber 23 for transmitting only the radiation from the emissive means 10 to the filter 22 (optional). The light transmitted through optical fiber bundle 23, filter 22 and sensor material 16 is then made incident on a phototransistor 50, these elements being similar to those as described with respect to FIGS. 5 and 6. Phototransistor 50 may be a photo-darlington transistor. A shutoff circuit 848 regulates the fuel flow to burners 2 and 3*b* by closing valve 8 when there is no flame or when concentration of the target gas increases beyond a given level. As discussed below, the circuit may also be used to vary the air-fuel mixture as a function of burning efficiency.

The positive output 30 of the photovoltaic array 28 is coupled to the positive input lead 38 of the cutoff coil 34 and to the emitter 96 of a PNP transistor 90. The positive output 30 is also coupled to one end 152 of potentiometer 150, to the positive power supply input 138 of operational amplifier 130 and also to the bias select input 142 of operational amplifier 130. Additionally, the positive output 30 of the photovoltaic array 28 is coupled through load resistor 56 to the negative-sensing input 134 of operational amplifier 130. The wiper 156 of potentiometer 150 is coupled to the positive-sensing input 132 of operational amplifier 130. The other end 154 of potentiometer 150 is coupled through resistor 100 to the negative input lead 36 of the cutoff coil 34. The output 136 of operational amplifier 130 is coupled through a base resistor 98 to the base 92 of PNP transistor 90. The collector 94 of transistor 90 is coupled to the negative input lead 36 of the cutoff coil 34. The negative output 32 of photovoltaic array 28 is coupled to the negative power supply input 140 of the operational amplifier 130 and to the negative input lead 36 of the cutoff coil 34 through resistor 100.

The phototransistor 50 is included for conducting current inversely proportional to the concentration of the target gas. The collector 54 of phototransistor 50 is coupled to the negative-sensing input 134 of operational amplifier 130. The emitter 52 is coupled to the second end 154 of the potentiometer 150 and to the negative input lead 36 of the cutoff coil 34 through resistor 100.

The emissive element 11*a* may consist of a length of Nichrome wire of thickness 0.005 to 0.010 inch wound into a coil of about ½ inch diameter and length of about 4 inches. Placed about 2 inches below the emissive element is an array of silicon photovoltaic cells 28 consisting of six cells, each ½ inch wide and 1½ inches long and connected in series so that the total output voltage is the sum of the voltages generated by the individual cells. A portion of the radiation 6 produced by emissive means 10 strikes a target gas detection material 16 which is preferably in the form of carbon monoxide-sensing material. The optic fiber 23 is 4 inches long and serves to allow the placement of the gas-sensing material in a region that is cooler relative to the pilot burner 3. The optic fiber 23 may act to filter out the longer wave infrared components of the radiation depending on its composition, i.e., glass, plastic, or silicon dioxide, thereby assisting in keeping the sensing material and its holder cool and enhancing sensitivity. The operational amplifier 130 may be a TLC 251 operational amplifier by Texas Instruments, Inc. The principal requirement is that the operational amplifier be able to function with supply voltages as low as 1 volt.

The photovoltaic control system of FIG. 11 may provide for the use of a fiber optic with one end in or near the flame 4, for heating by the flame. The emissive means, containing a thermally stimulated quantum emitter such as lanthanide oxides, is coated on the heated end for producing radiation of a characteristic wavelength. The fiber optic transmits the radiation to the other end, which end has been etched and coated with the CO-sensitive material for inhibiting transmission of radiation when carbon monoxide is present (see FIG. 27).

If flame is present, the photovoltaic array 28 will produce enough power from the radiation to operate both the CO detection circuit and the magnetic latched valve 8. A fraction of the radiation is converted to electric power of approximately 3 milliwatts, at 1.7 volts and a current of 1.8 milliamperes. Radiation 6 also illuminates the end of the optic fiber 23, which conducts the light to the CO-sensitive material. If the CO-sensitive material is transparent, the radiation is transmitted to photo-darlington transistor 50.

In operation, light generated by emissive means 10 will pass through optic fiber 23 and the CO-sensitive material held in holder 14 and strike the photo-darlington transistor 50. The transistor is thereby caused to conduct current. Since the current of the photo-darlington transistor is provided through resistor 56, the voltage at the junction of resistor 56, collector 34 and the negative-sensing input 134 of the operational amplifier 130 will be reduced. The potentiometer 150 is adjusted so that the voltage at 132 will be more positive than the voltage at 134 if CO is not present. This ensures that the output at 136 will be in the high state, preventing transistor 90 from conducting current. The valve then operates normally.

If CO is present, as detected by the CO-sensitive material, the CO-sensitive material will darken, thereby reducing the amount of light striking phototransistor 50. This reduces the current drawn by phototransistor 50 from the positive output conductor 30 of the photovoltaic array 28. As a result, the voltage at the negative-sensing input 134 rises. This occurs even though the extent of darkening is related to the time dependent concentration of carbon monoxide. The point at which cutoff o the coil occurs can then be set for a value related to a human dose. If the CO concentration exceeds 50 parts per million (ppm) for 4 hours, or 200 ppm for thirty minutes or over 350 ppm for 10 minutes, the gas sensor 15 will darken sufficiently so that the voltage at the negative-sensing input 134 will exceed the value set at the positive-sensing input 132. This will cause the output 136 of operational amplifier 130 to enter the low state, thus drawing current through base resistor 98 from the base 92 of transistor 90, causing transistor 90 to conduct. The conduction through transistor 90 diverts the current which formerly flowed through cutoff coil 34, thereby closing the valve.

Figure 12:
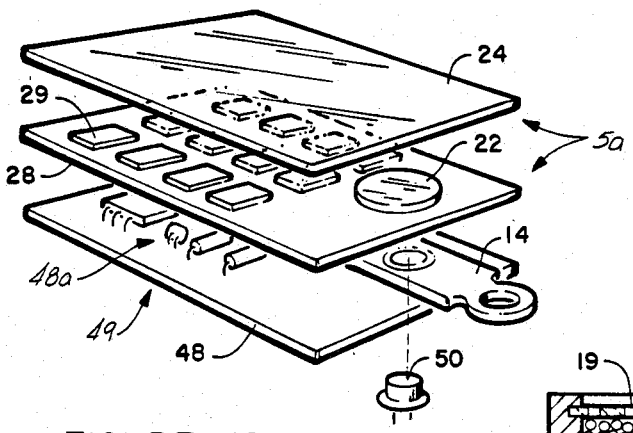
FIG. 12 is a schematic and perspective view of a sensor and control apparatus for use with a combustion device such as that shown in FIGS. 5 or 11.

FIG. 12 shows an arrangement for combining the elements of the photovoltaic control system 5 into a single photovoltaic control unit 49 for controlling combustion in a combustion device. The cutoff circuit 48*a* is provided on a circuit board 48 to which is to be attached the phototransistor 50 and the holder 14 for the gas-sensing material. Oriented above the cutoff circuit 48 is the photovoltaic array 28 consisting of, for example, a 4×3 array of individual photovoltaic cells 29. The photoelectric array also includes, in a preferred embodiment, a filter 22 for filtering the radiation to be incident on the phototransistor 50. The entire sensor apparatus is covered by a cover glass 24. The location of the photovoltaic control system 5 relative to the combustion apparatus is dependent upon the means for transferring the radiation from the emissive means 10 to the control system 5. Optical fibers may be used to couple the radiation from the emissive means 10 to the photovoltaic array 28, enabling the photovoltaic system 5 to be placed at a distance relative to the combustion device. However, if a direct light line must be maintained between the emissive means 10 and the photovoltaic array 28, the control unit 49 must be placed closer to the combustion source.

Figure 13:
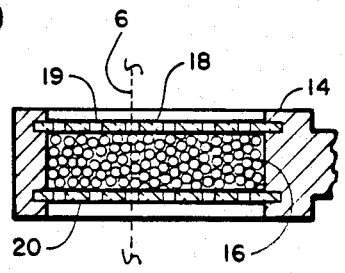
FIG. 13 is a schematic and side sectional view of a combustion product sensor and holder for use with a combustion device such as that shown in FIGS. 5 or 11.

FIG. 13 shows in detail the gas-sensitive material 16 and the holder 14 therefor. Radiation 6 is transmitted through sensitive material 16 when low concentrations of the particular gas to be sensed are present. Gas inlet holes 19 are provided in transparent windows 18 and 20 for admitting gas molecules to the sensitive material 16.

The gas-sensitive material may be coated on silica gel and placed in the holder 14. The silica gel sensor material is not suitable for direct application to the surfaces of photovoltaic cells nor to plates such as plates 15 in FIG. 2 because silica gel reduces the intensity of the incident light through scattering and absorption unrelated to absorption due to changing color of the sensor material. Furthermore, silica gel particles are difficult to evenly distribute over a large area such as that contemplated for the photovoltaic array 28. Additionally, small silica gel particles are difficult to bond without damaging the chemical sensor property of the sensor material coated thereon. Silica gel is also easily dehydrated at elevated temperatures and may be damaged. Therefore, the thin film coating described with respect to FIGS. 2–4 is a preferred method for incorporating the gas-sensitive material in the photovoltaic control system 5 which has some advantages over the method of FIG. 13.

Figure 14:
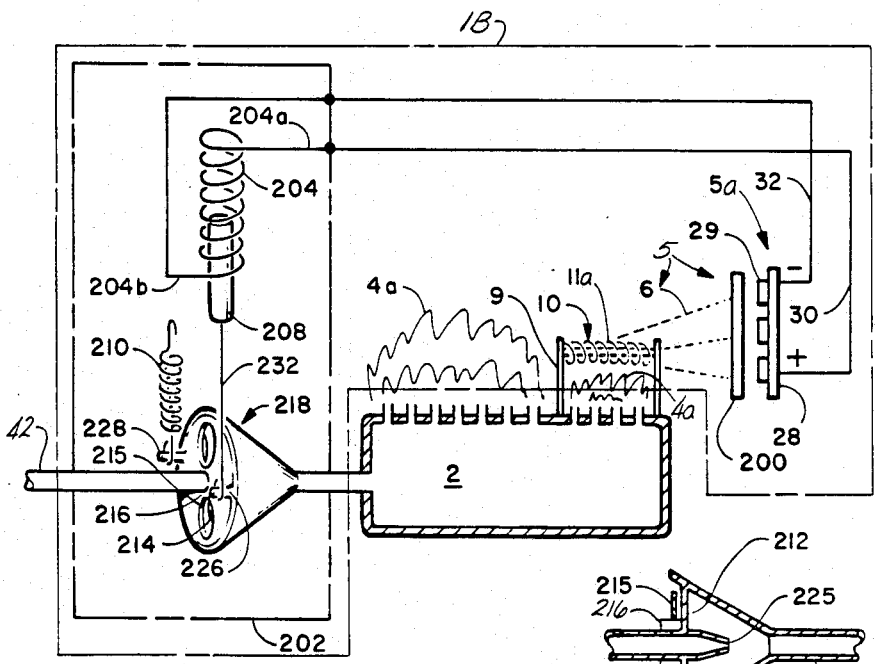
FIG. 14 is a schematic diagram of a combustion device including means for adjusting the air-fuel mixture.

FIG. 14 shows an efficiency control system 1B for controlling the air-fuel mixture delivered to the main burner 2. The photovoltaic control system 5 is similar to those descried above with respect to FIGS. 1, 5, and 11, except that the emissive means 10 is preferably located at the main burner 2 for producing radiation of the characteristic wavelength. Furthermore, the photovoltaic control system 5 includes a spectral filter 200 for filtering out most of the radiation except that of the characteristic wavelength. Fuel is provided through pipe 42 into a gas-air proportioning valve 202 for mixing the fuel and air. The proportioning valve includes an air-fuel mixing chamber 218 for mixing the fuel from pipe 42 with the air pulled in through air holes 215. The mixed air and fuel is then transported to main burner 2 for producing heat or flame 4*a*. A portion of the main burner includes the emissive means 10 comprising an emissive element 11*a* supported by radiant coil holder 9. Alternatively, the emissive element 11*a* may be incorporated into the structure of burner 12. The emissive element 11*a* produces radiation 6 for illuminating or irradiating the spectral filter 200 and the photovoltaic array 28. The positive output 30 of the photovoltaic array 28 is coupled to a first lead 204*a* of a coil 204, and the negative output 32 of the photovoltaic array 28 is coupled to the second lead 204*b* of coil 204.

A permanent magnetic armature 208 is movable within coil 204 and coupled to a post 226 through a rigid member 232 for controlling the mixture chamber.

Figure 15:
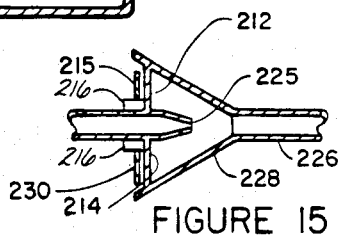
FIG. 15 is a side sectional view of a portion of the apparatus of FIG. 14 for adjusting the air-fuel mixture.

As shown in FIG. 15, the mixing chamber 218 includes a nozzle 225 terminating the inlet pipe 42. An exit pipe 226 is included for transporting the air-fuel mixture away from the chamber 218.

The operation of the control system of FIG. 14 is based on the proportionality between the intensity of the radiation 6 from the emissive means 11 and the extent to which the emissive means 11 is heated by flame 4. As the flame, and hence the emissive element 11, become hotter, the amount of near infrared and visible light produced thereby increases and the spectral peak shifts toward shorter wavelengths. Since the photovoltaic cells 29 are sensitive to both the amplitude and the wavelength of the resulting radiation 6, the amount of photocurrent produced is a sensitive function of flame temperature. The resulting photocurrent and potential produced by the photovoltaic array 28 may be used to control the amount of air flowing into the fuel-air mixture, thus optimizing the air-fuel ratio to maximize the flame temperature. Since the emissive means may be made of materials with low thermal mass, such as 0.01-inch diameter Nichrome wire or smaller ceramic filaments, the control system can respond very quickly to temperature changes.

The spectral filter 200 may be similar to the filters described above with respect to FIGS. 5 and 11. The filter is employed to reduce heating of the photovoltaic array 28 due to incident radiation and to aid in controlling the spectral response of the control, e.g., to aid in preventing too lean an air-fuel mixture.

As discussed above with respect to the previously-described control devices, fuel gas flows through inlet pipe 40 to the gas-air proportioning valve 202. Fuel passes through nozzle 225 and the resulting expansion causes air to be drawn in through the holes 214 and 215 in the aperture plates. The gas-air mixture then flows through pipe 42 to the burner 2 where it is ignited by conventional means (not shown). The emissive element 11 placed within the flame 4 is heated to incandescence or luminescence. A portion of the resulting radiation may be directed (through various means as described above) through spectral filter 200. The filtered radiation then strikes photovoltaic array 28 producing an electric potential and current. The photocurrent is conducted through conductors 30 and 32 to the coil 204 in the proportioning valve 202. The movable armature 208 moves in or out of the coil 204 depending on the change in current in conductors 30 and 32 with changes in the amount and wavelength of radiation produced in the emissive element 10. The movement of the armature 208 is transferred to the rotating aperture plate 230 through post 226. The current flowing in coil 204 is so arranged that the magnetic field thus produced exerts an attractive force on armature 208 thereby pulling on post 226 for rotating the rotating aperture plate 230 in opposition to the biasing spring 210. As a result, the relative positions of apertures 215 and 214 can be varied, thereby varying the flow rate of incoming air. The combustion efficiency may be determined by the maximum current for a given fuel flow. The resisting force produced by spring 200 is proportional to the degree of rotation of the rotating aperture plate 230. Therefore, rotating aperture plate 230 will rotate about bearings 216 such that the force exerted on the armature 208 is exactly balanced by the restoring force produced by spring 210. As a result, the amount of rotation of rotating aperture plate 230 will be proportional to the amount of photocurrent produced, which is a function of the temperature of the flame. A portion of exhaust may be passed over a CO sensor plate (not shown), whereby the production of CO could be used to darken the plate. The resulting reduction in photocurrent could be used to call for more air for increasing the efficiency. The device of FIGS. 14 and 15 may be adapted to any combustion source, such as those discussed herein.

The initial mechanical, electrical, and optical parameters may be adjusted so that for a chosen fuel setting, the amount of air admitted to the mixing chamber will be automatically adjusted so s to produce the desired flame temperature.

Figure 16:
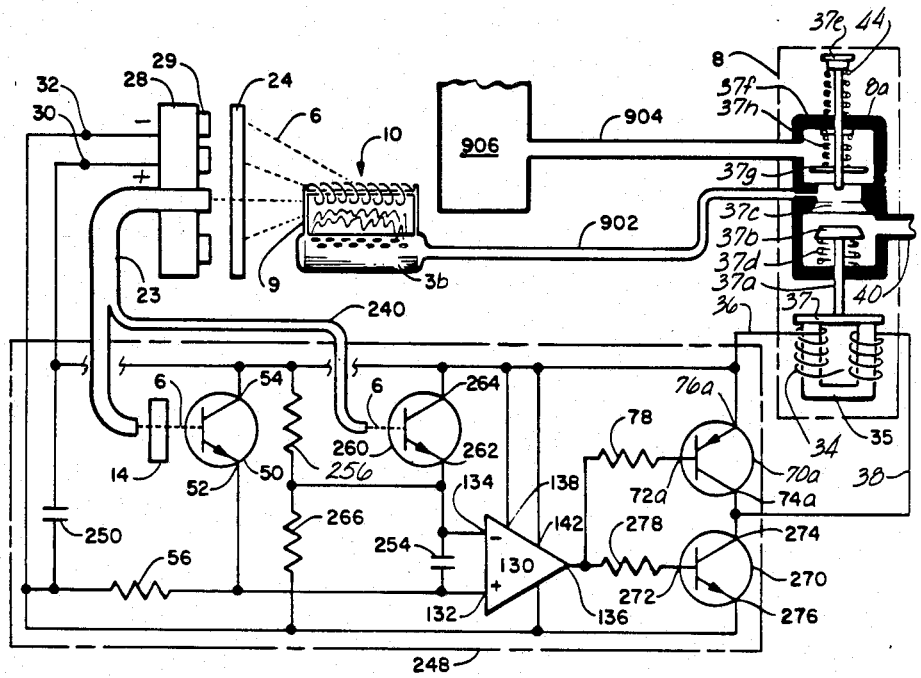
FIG. 16 is a schematic diagram of a fourth embodiment of a combustion device including a fuel flow control valve, a photoelectric and combustion product sensors in combination with light guides and an electric circuit for controlling the fuel valve.

FIG. 16 shows one preferred embodiment for a photovoltaic safety control system and includes the latched fuel control valve 8, a main burner 906 fed by a pipe 904 from the valve 8, and a pilot burner 3*b*, similar to those described above, fed by a pipe 902 from the valve 8. The remainder of the photovoltaic control system 5, in addition to the pilot burner 3*b*, includes the same elements as described above with respect to FIG. 5, and the structure and function of those elements will not be described again.

The embodiment of FIG. 16 provides for a reference signal derived from the generated light in such a way so as to provide compensation for changes in the amount of light produced by the emissive element, against variations in voltage produced by the photovoltaic control system and against variations in the photodetector signal caused by environmental factors, such as temperature.

The positive output 30 of the photovoltaic array is connected to one side of a filtering capacitor 250 (optional), the collector 54 of phototransistor 50, one side of a resistor 256, a collector 264 of phototransistor 260, the positive power supply input 138 and the bias select input 142 of amplifier 130, the emitter 76*a* of shorting transistor 70*a*, and to one side 36 of coil 34. The negative output 32 of the photovoltaic array 28 is connected to the other side of capacitor 250 (optional), to one side of resistor 56, one side of resistor 266, the negative power supply input 140 of amplifier 130, and to the emitter 276 of series switch transistor 270. The other side of resistor 56 is connected to the emitter 52 of transistor 50 and also to one side of a filtering capacitor 254 (optional). The other side of resistor 56 is also coupled to the positive sensing input 132 of amplifier 130. The other side of resistor 266 is connected to the emitter 262 of transistor 260, the other side of resistor 256, the other side of capacitor 254, and to the negative sensing input 134 of amplifier 130. The output 136 of amplifier 130 is coupled to one side of resistors 78 and 278. The other side of resistor 78 is connected to the base 72*a* of transistor 70*a*. The other side of resistor 278 is coupled to the base 272 of transistor 270. Collector 74*a* of transistor 70*a* and the collector 274 of transistor 270 are coupled to the other side 38 of coil 34. An optical fiber 23 is also provided for transmitting a portion of the light 6 from the emissive element 11*a* to the bas of the phototransistor 260 and to the base of phototransistor 50. The light from optic fiber 23 transmitted to the base of phototransistor 50 is passed through the target gas-sensing means, for example, the CO-sensitive material contained in holder 14, prior to irradiation of the base of phototransistor 50.

As discussed above, the fuel valve 8 contains the coil 34 wound on the pole piece 35 made of magnetic material of very low hysteresis and incapable of sustaining permanent magnetism. This material is generally known in the art as material appropriately characterized for this purpose. When the pole piece 35 is magnetized by virtue of the current flowing through the coil, the armature is held against the spring by magnetic attraction to the end of the pole piece. If the current through the coil and hence the magnetic force is reduced such that the magnetic force is less than that needed to overcome the spring, then the spring causes the armature to move away from the pole piece. This action causes the valve to close. This operation is identical to the type of valve employed in thermocouple-controlled valves except that, because the magnetic field is proportional to the product of the number of turns of wire comprising the coil and the current flowing therein and because the photovoltaic means provides a much higher voltage than a thermocouple but at a much lower current, it is necessary to use smaller diameter wire and to increase the number of turns on the coil until a similar value of the magnetic field is produced as would be found in the case of a coil powered by a thermocouple. Typical thermocouple systems utilize 15 to 20 turns of #22 wire whereas photovoltaic controls require anywhere between 100 to 10,000 turns of finer wire, such as #35 to #47 wire.

Under normal operating conditions, the photovoltaic array 28 of the particular device shown in FIG. 16 produces approximately 1.6 to 1.8 volts. This provides the power for the circuit to operate the coil 34 in the latched valve 8. The resistor 56 is chosen so that if carbon monoxide is not present, the potential produced by the photocurrent from phototransistor 50 flowing across resistor 56 and applied to the positive-sensing input 132 of amplifier 130 is approximately 250 millivolts. At the same time, for comparison purposes, the photocurrent produced by phototransistor 260 and the small additional current provided through resistor 256 flows through resistor 266 and produces a potential of approximately 150 millivolts at the negative-sensing input 134 of amplifier 130. Small variations in these potentials caused by flame flicker may be smoothed with the capacitors 250 and 254 (optional). The difference in voltage, as defined at the inputs 132 and 134 of amplifier 130 is positive by an amount equal to approximately 100 millivolts. Since the positive-sensing input 132 is at a higher potential than the negative-sensing input 134, the output 136 of amplifier 130 is in the high state. The output voltage exceeds 1 volt The base current flowing to transistor 270 is sufficient to keep the transistor 270 in the on state and in saturation. At the same time, there is insufficient base current flowing to transistor 70*a* to turn it on.

In one embodiment using the photovoltaic array described above, the coil comprises 4,000 turns of #45 wire such that the potential across the coil was normally about 1.3 volts at a current of about 1.2 milliamperes. If the current reduces through the coil below 600 microamperes, the coil will release and the valve will close. Preferably, the release point for the valve occurs at a current of about one-half the normal operating current. Additionally, the minimum voltage required of the photovoltaic array 28 is approximately 1.1 volt. If the system voltage drops to 1.22 volts or below, the output voltage of the amplifier 130 will be restricted to a point where it would be insufficient to allow the transistor 270 to remain in the on condition. The current in the coil will thereby be reduced, closing the valve. This prevents the burner from operating under conditions where the system voltage is too low for proper circuit operation, but still high enough to keep the coil energized.

Figure 34:
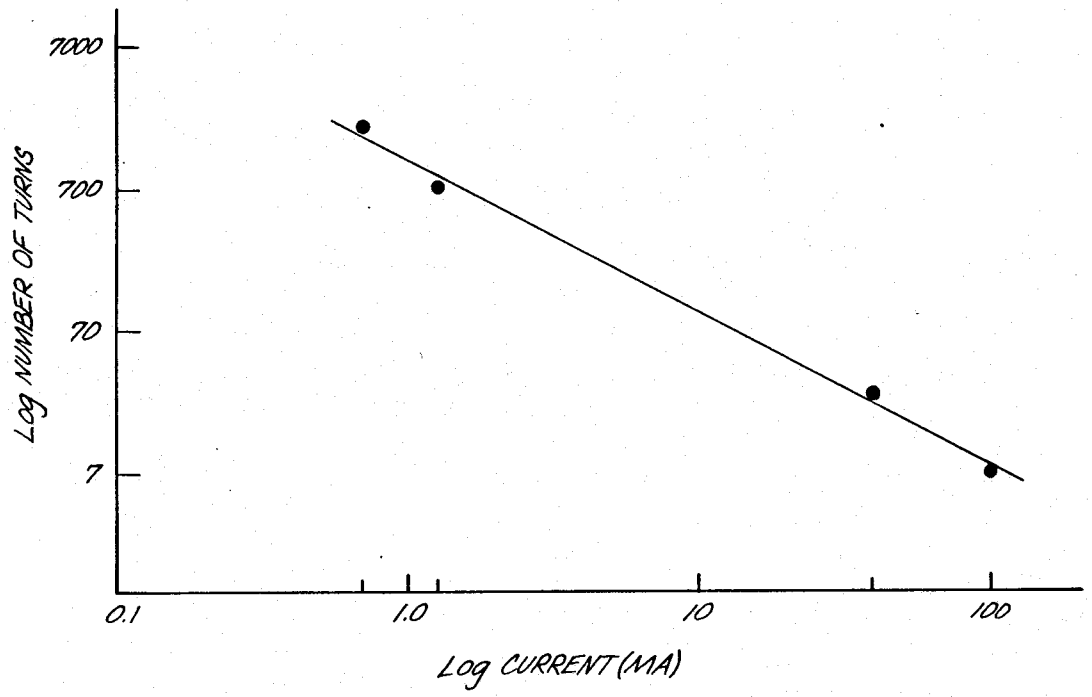
FIG. 34 is a graph of the relationship between the number of turns in and the current through a coil in the fuel valve.

FIG. 34 shows a graph on a log-log scale of the relationship between the number of turns in and the current through the coil. The line was developed from the following table of values:

| No. of Turns | Current (mA) |
|---|---|
| 7 | 100 |
| 25 | 40 |
| 700 | 1.25 |
| 2000 | 0.700 |

The graph gives the preferred relationship for a coil operating with the photovoltaic array discussed above. The particular arrangement used depends on the array, the first spring 37*b*, and the type of wire used. Other coil configurations of 700 turns, or 400 turns together with an impedance of about 250 ohms, have been used. Other arrangements may be employed. Preferably, an optimum design is obtained with the largest diameter wire while still maintaining the same electromagnetic field.

In operation, light 6 from the emissive element 11*a* is transmitted through the CO-sensing material held in holder 14 to the phototransistor 50. A photocurrent is conducted by the phototransistor 50 which flows through resistor 56, generating a potential across resistor 56 which is applied to the positive-sensing input 132 of amplifier 130. A portion of light 6 is also conducted to the phototransistor 260 for producing current through resistor 266. The potential developed across resistor 266 is applied to the negative-sensing input 134 of amplifier 130. A resistor 256 provides a small additional current to generate a small potential across resistor 266 in the event of failure of optic fiber 23 or phototransistor 260.

Current for coil 34 flows from the positive lead 30 of the photovoltaic array 28 through conductor 36 to the coil and then through conductor 38 and transistor 270 to the negative conductor 32 of the photovoltaic array. If carbon monoxide is present, the CO-sensing material in holder 14 darkens, thereby inhibiting the transmission of light 6 to the phototransistor 50. A reduction in the potential at the positive-sensing input 132 is ultimately produced. When the reduction in the potential exceeds 100 millivolts, the output 136 of amplifier 130 will change state and decrease. As a result, the reduced base current to transistor 270 will reduce the current in the coil 34. Additionally, current will be drawn from the base 72*a* of transistor 70*a* causing the transistor to conduct. This provides an alternate path for the current to the coil.

Figure 17:
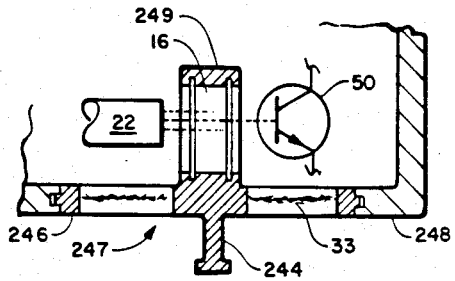
FIG. 17 is a schematic add partial side sectional view of a combined sensor/getter cell for isolating the combustion product sensor from undesirable particles and from interfering gases.

FIG. 17 shows an apparatus for eliminating large particles from the inlet gas to the target gas-sensing means 16. A combined sensor/getter cell 247 includes a getter 33 placed in the only two air paths into the target gas-sensing means 16. A light-tight and very clean environment for the sensor can be maintained using the getter material, such as treated charcoal cloth. The use of a getter will prevent light, dust, bugs, and gases, such as sulfur dioxide, from interfering with the optical sensing system. The light, tight fiber system greatly reduces interference from sunlight and other sources of noise. The cell 247 is easily removed and replaced as a single unit by means of a handle 244. The target gas-sensing material 16 may be contained in a holder similar to that described with respect to FIG. 13. The cell may be adapted for accepting an optic fiber element 22 which transmits light 6 through the sensor material 16 when no target gas is present. In a case where the target gas-sensing material is a CO-sensitive material, the transmission of light will be inhibited when the concentration of carbon monoxide increases. When the transmission of light through the CO-sensitive material decreases, the photodetector 50 and its associated circuit similar to those described above detect the reduction of light and regulate the combustion apparatus in a manner similar to that described above. The sensor/getter cell is made of a flexible material allowing it to be snapped into the case 248 through its snapping elements 246. Other mechanical systems such as a screw or key slot mechanism is possible.

Figure 18:
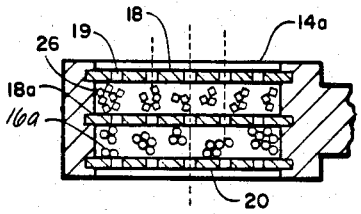
FIG. 18 is a schematic and side elevation view of a section of a gas sensor and holder showing sensors for sensing different gases similar to the combustion product sensor and holder of FIG. 13.

A multiple gas-sensing means 14*a* is shown in FIG. 18 as an alternative embodiment to the gas-sensing means 16 of FIG. 13. The sensing means 14*a* includes a first optically transparent substrate material 16*a* on which is coated or impregnated a first gas-sensing material. The first gas-sensing material may be the CO-sensitive material as described in Shuler et al. Also included in the gas-sensing means 14*a* is a second optically transparent substrate material 26 upon which is coated or impregnated a second gas-sensing material, which may be the acid gas-sensing material. The substrate materials are retained by, and supported within, parallel spaced-apart transparent and porous membranes 18 and 20 for allowing the passage of light into the area between the membranes. Membranes 18 and 20 include openings 19 for allowing the infusion of gases, including the target gases to be sensed. The membranes 18 and 20 may be transparent plastic or glass windows with small holes forming openings 19. The membranes 18 and 20 are similar to those described with respect to FIG. 13. In a case where the first substrate material 16 and its gas-sensing material, and the second substrate material 26 and its gas-sensing material are chemically incompatible, they may be separated by a common window 18*a* between membranes 18 and 20. Otherwise, the first and second substrate materials may be intermixed.

The gas-sensing means 14*a* may be positioned as required to allow transmission of light to the photovoltaic array when target gases are not present and to inhibit the transmission of light when a target gas is present.

The embodiment of the gas-sensing means 14*a* of FIG. 18 may be considered as equivalent to a plurality of gas sensors in series along the light path traveled by light 6. Similarly, where the gas-sensing means 14*a* comprises physically separate gas-sensing means and separate holders, the plurality of gas-sensing means may be oriented, serially or in parallel along the light path traveled by light 6 for achieving the same result. If the plurality of gas-sensing means do not all optimally absorb light at the same or similar characteristic wavelength, the gas-sensing means may be located in parallel relationship with respect to each other. This may enhance the sensitivity of the photovoltaic shutoff system.

Figure 19:
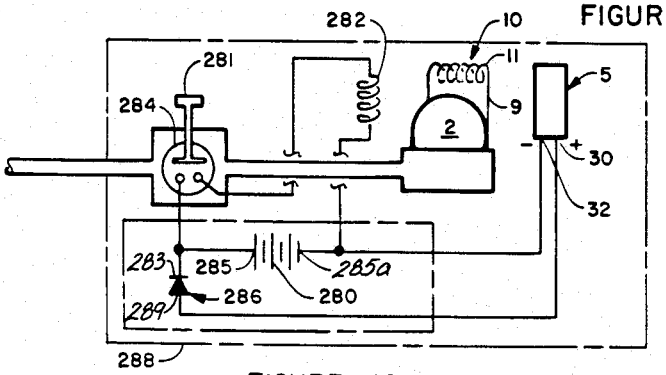
FIG. 19 is a schematic diagram of an electronic ignition device for use with the combustion device of the present invention.

One of the additional electronic devices capable of being operated with the photovoltaic means 5*a* is an electronic ignition device. FIG. 19 shows such an electronic ignition device 288. The electronic ignition device 288 is coupled through the connectors 30 and 32 of the photovoltaic means 5*a* for providing electronic ignition to the combustion device. The electronic ignition device includes a diode 286 having an anode 289 coupled to the positive conductor 30 of the photovoltaic means 5*a* and a cathode 283 coupled to the positive side 285 of a storage battery 280. The negative side 285*a* of the battery 280 is coupled to the negative conductor 32 of the photovoltaic means 5*a*. The cathode of the diode and the positive terminal 285 of battery 280 are coupled to one terminal of an ignition switch 284 having a switch thermostatic control or push button 281. The ignition switch 284 includes a second terminal with a conductor leading to a hot wire ignition coil 282 for igniting the air-fuel mixture in the combustion device. The other end of the coil 282 is coupled to the negative terminal of battery 280.

When ignition is desired, the user pushes ignition switch button 281 which closes the switch 284 and opens the gas flow to the burner 2. The closure of switch 284 allows current to flow from the positive terminal 285 of battery 280 through the ignition wire 282 to the negative terminal 258*a* of battery 280. The current flow causes the ignition wire to become very hot so that the gas issuing from the burner 2 is ignited. Similar to the operation of the photovoltaic systems described above, the resulting flame heats the emissive means to incandescence, or other radiation emission state, resulting in electric current flowing from the photovoltaic means 5*a*. Because the ignition switch button 281 is released upon ignition, current stops flowing from battery 280, and the current developed in the photovoltaic means 5*a* serves to recharge the battery 280 through diode 286.

Alternatively, an electronic servo control mechanism connected to a thermostatic device may be employed to actuate the photovoltaic ignition control system. Additionally, ignition may be enhanced by the use of a catalytic wire for catalyzing the ignition of the fuel. Other common electronic devices, such as displays, may also be driven by the apparatus is herein described.

The various types and configurations of emissive elements will now be described specifically with respect to FIGS. 21–28 an generally with respect to FIGS. 1, 5, 11, 14, and 16. Emissive elements generally fall into the categories of near-black body emitters and thermally stimulated quantum emitters. Several near-black body emissive elements are shown in FIGS. 1, 5, 11, 14, 16, 19, 20, 21, and 25. The specific element to be used depends on the specific application. For example, the preferred emissive element is one that emits radiation near the wavelengths of 675 nanometers or of 890 nanometers when the sensor being used with the combustion device is the Shuler CO-sensing material, which absorbs strongly at around 675 nanometers (such as helmium or erbium) and around 890 nanometers. Conversely, when the emissive means is to be used specifically for the photovoltiic array, the desired wavelength of the emitted radiation will depend on the particular photovoltaic spectral response. Additionally, separate and distinct characteristic wavelength emitters may be used in one combustion device to optimize the various absorption characteristics of the different sensors and photovoltaics. An emissive element in the form of a simple wire coil or a wire mesh may be used made of high-temperature metals and alloys, such as Nichrome, tantalum, inconel, or stainless steel. Nichrome is an alloy of nickel and chromium, and is the Registered Trademark of Driver-Harris Co. The form of Nichrome used as the emissive means is preferably 80–20 or 70–30 (nickel-to-chromium). A Nichrome wire is usually coated with an oxide, carbide or nitride to inhibit oxidation of the metal. Invar is an iron-nickel alloy containing approximately 40 to 50% nickel.

The metals of the wire coil or mesh may be coated with various coatings in order to inhibit oxidation of the metal. Metals, such as Invar, may be coated with silicon dioxide because the thermal expansion coefficients are similar. Other metals listed above may be coated with oxides, carbides, nitrides or other ceramics, such as zirconia, aluminum oxide, silicon nitride, molybdenum, tungsten disilicide, boron nitride, boron carbide, titanium dioxide, or silicon carbide or mixture thereof. The coating need be only a few hundred microns to a few thousand microns thick. The thickness of the wire can be from less than 0.001-inch diameter to well over tens of thousandths of an inch, depending on the temperature of the flame, type of fuel, pressure, and other combustion parameters.

Coils made of ceramic filaments or mixtures of ceramics bonded together may also be employed in place of metal or metal-coated wires. Silicon carbide, aluminum oxide, aluminum silicate, and silicon dioxide filaments are also suitable. The silicon carbide filament has strong emissive qualities, high strength and ductility, and is very small in diameter. For example, the filament may be smaller than 0.0001 inch. The smaller size allows the filament to be heated and cooled much faster than the wire or coated metal wire products. Ceramics generally can be heated to an emissive state faster and are much longer lived than metal products. Silicon dioxide filaments are inexpensive and last longer under oxidative conditions than do silicon carbide filaments. Aluminum oxide, aluminum silicate, zirconium oxide, boron carbide, and silicon nitride filaments are also oxidation-resistant at high temperatures.

FIG. 20 shows a ceramic pilot burner 3*c* in which a ceramic emissive element may be mixed. The burner is then formed or molded with small protruding fingers 300 in a burner surface plate 25. The ceramic emissive material in the fingers 300 then emit radiation upon heating during combustion. The photovoltaic means 5 operates as previously defined.

Figure 21:
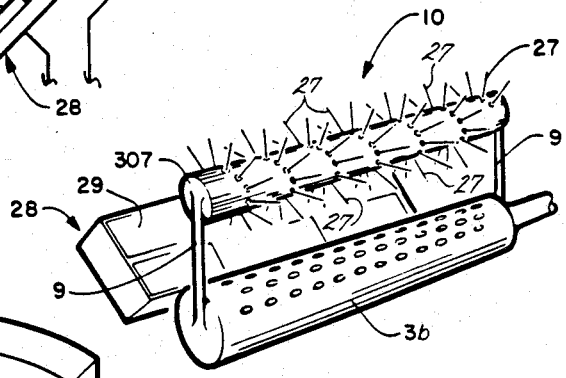
FIG. 21 is a schematic and perspective view of a ceramic fiber emissive element molded to a ceramic rod.

FIG. 21 illustrates the use of ceramic fibers 27 bonded perpendicular to a cylindrical surface of a ceramic rod 307 to be placed in the flame (not shown) above the pilot burner 3*b*. This arrangement allows quick heat-up and cool-down of the fibers during transient conditions in the combustion device.

Figure 22:
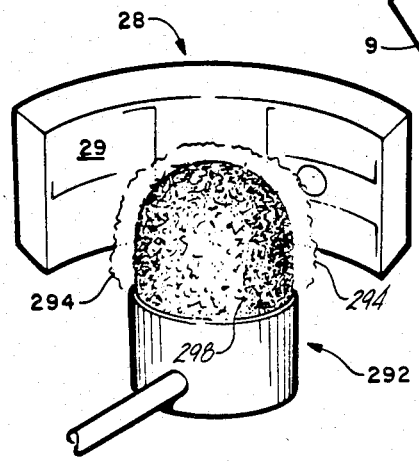
FIG. 22 is a schematic and perspective diagram of a porous ceramic surface burner and a curved photovoltaic sensor.
Figure 23:
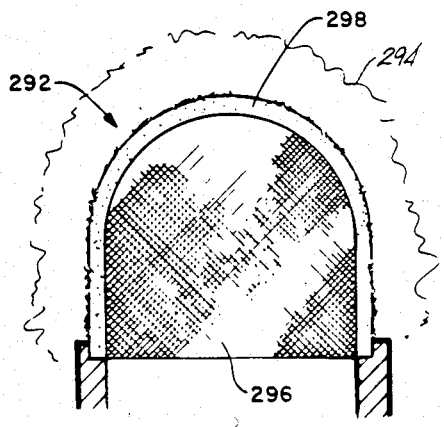
FIG. 23 is a schematic and side sectional view of a burner similar to that of FIG. 22 showing a screen, a porous ceramic wall and fibers.
Figure 24:
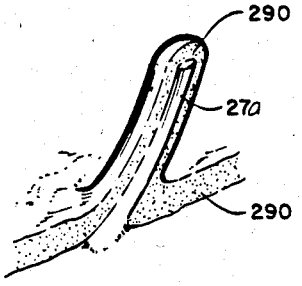
FIG. 24 is a schematic and perspective view of a fiber for use in the device shown in FIG. 23.

Ceramic fibers and filaments may be incorporated in the surfaces of ceramics, as depicted in FIGS. 22–24. FIGS. 22 and 23 show a surface combustion pilot burner 292 having a porous ceramic matrix 298 for producing combustion indicated at 294. The ceramic matrix 298 has incorporated therein a ceramic fiber 27*a* or various blends of ceramic fibers similar to the fiber 27 described with respect to FIG. 21. The ceramic matrix 298 is formed so that the incorporated fiber 27*a* protrudes slightly from the porous surface of the ceramic matrix. As shown in FIG. 23, the ceramic matrix 298 is formed over a screen 296 to provide a form for the matrix. The characteristics of the fibers 27*a* are the same as the ceramic fibers previously described.

FIG. 24 depicts an alternate embodiment of the porous ceramic matrix 298 of the burners of FIGS. 22 and 23. In this preferred embodiment, the fiber 27*a* and surface of the matrix 298 may be coated with a thermally stimulated quantum emitter 290, such as a rare earth element, to constitute the emissive element. For example, a ceramic matrix may include holmium, erbium, cerium, or cobalt oxides, or other rare earth, transition metal, or actinide oxides. These thermally stimulated quantum emitters have an unfilled inner shell electron in the higher orbitals. The excitation and deexcitation of the electron causing transition from one orbital to another lead to the production of a very narrow band of emitted radiation which is not black body radiation. A thermally stimulated quantum emitter is also beneficial because it is generally insensitive to environmental changes such as changes in fuel, temperature, and altitude. The emitter 290 in FIG. 23 is tuned to the wavelength which is absorbed most strongly by the target gas sensors, or which is converted most efficiently by the photovoltaic array. The emitter material is selected depending on the specific wavelength region required and on the particular electron orbital configuration and vacancies in the inner shells of the rare earth elements.

Figure 25:
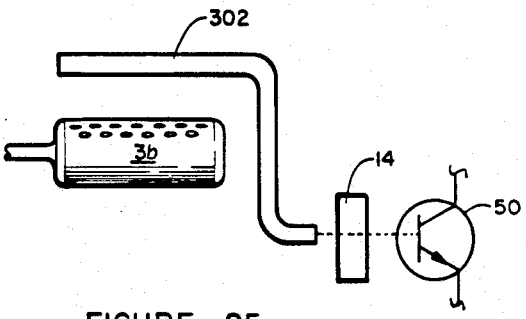
FIG. 25 is a schematic and side elevation view of a fiber optic emissive element.
Figure 26:
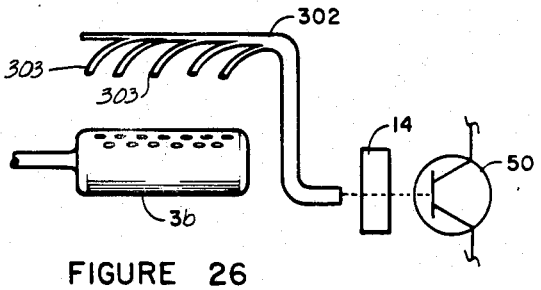
FIG. 26 is a schematic and side elevation view of the multiple-strand fiber optic emissive element alternative to the fiber optic emissive element of FIG. 25.
Figure 27:
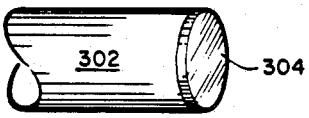
FIG. 27 is a perspective view of a gas sensor coated on one end of a fiber optic emissive element.

FIGS. 25–27 illustrate novel applications for a single-strand silicon dioxide filament 302 as an emissive element in the pilot burner 3a. The silicon dioxide filament functions as an emitter of radiation and as a conduit for transmitting the light to the sensor, as shown in FIG. 25. Furthermore, the silicon dioxide filament may be used in conjunction with the sensor material 304, as indicated in FIG. 27 wherein the target gas-sensitive material 304 is coated on the end of the optic fiber. One end of the silicon dioxide filament may be treated to produce a larger surface area and the sensor material is then coated thereon. Multistrand or single quartz fibers or other optical fibers may be used as desired, depending on the properties required. Small fibers 303 can be used for quick start-up and shut-down because of their rapid heating and cooling (FIG. 26). Additionally, the fibers allow the sensor materials to be placed at a distance from the flame so that the sensor material remains relatively cool.

The emissive optical fiber 302 of FIG. 25 may be coated with one or more thermally stimulated quantum emitters (not shown). Similarly, element 303 in FIG. 26 may be coated with various thermally stimulated quantum emitters (not shown) to provide the same function as was described above with respect to the emitter 290 of FIG. 24.

Figure 28:
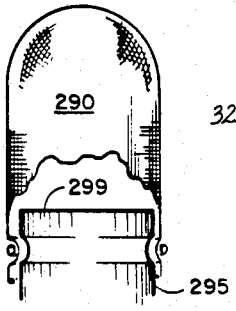
FIG. 28 is a schematic and side sectional view of a ceramic fiber-reinforced mantle in the form of a thermally stimulated quantum emissive element.

FIG. 28 illustrates the use of a ceramic fiber-reinforced mantle used for thermally stimulated quantum emission ,The mantle is formed from the usual organic fiber cloth and combined with ceramic fibers and a ceramic containing a thermally stimulated quantum emitter.

Figure 29:
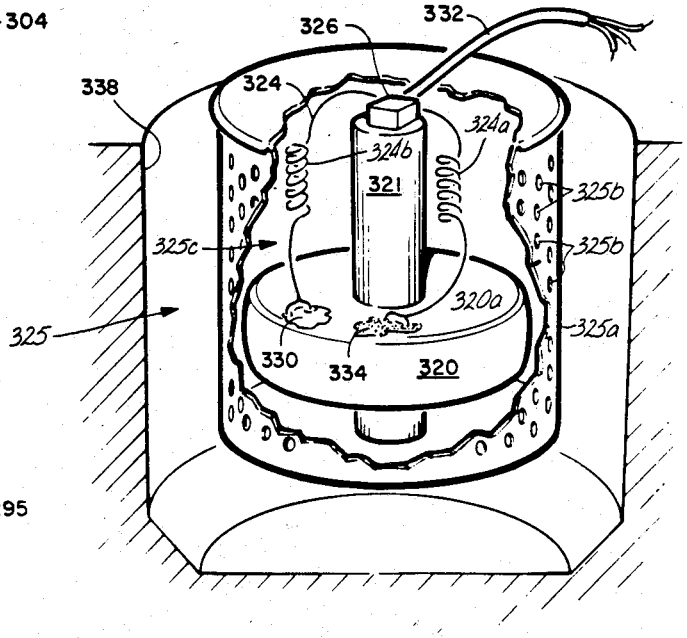
FIG. 29 shows a schematic perspective view of a cutaway portion of a combustible gas sensor for use in combination with the combustion device of the present invention for sensing combustible gases which are heavier than air.

Another embodiment of a target gas-sensitive means in the form of a combustible gas sensor 325 is shown in FIG. 29. The combustible gas sensor includes a right circular cylindrical canister 325a for providing a sheltered environment for the combustible gas and sensor therefor. A plurality of apertures 325b are provided in the circumferential face of the canister for allowing combustible gases to enter a detection chamber 325c, defined by the canister. In the present embodiment, the canister is placed in a cavity or sump 338 for the collection of combustible gases which are heavier than air. The sump may be placed in the floor of the area for which detection is to be made. The floor, sump, and canister form one mechanical gathering means for collecting and retaining the combustible gas in one are.. With such an arrangement, the sensitivity of the sensor is enhanced by enriching the gas-air ratio in the area of the detector.

The combustible gas sensor 325 includes a diskshaped doughnut float 300 within the canister for floating on any liquids which may be in the bottom of sump 338. The float is coaxially engaged with a ground pole 321 for rising and falling with the level of liquid in the bottom of the sump 338. There is an alarm (not shown which is triggered when flooding of the sump 338 occurs causing float 320 to rise above a predetermined level on pole 321. This alarm would alert one to the fact that water may inactivate the combustible gas sensor.

A catalytic-coated thermistor 334, to be described below, is placed on a top surface 320a of the float 320. A coated, but noncatalytic-coated, thermistor 330 is also placed on the upper surface 320a spaced apart from the catalytic-coated thermistor 334. The catalytic-coated thermistor 334 is electrically coupled to a junction 326 at the top of the ground pole 321 through expandable wire coil 324a. The noncatalytic-coated thermistor 330 is coupled to the junction 326 through expandable wire coil 324b Junction 226 includes wires 332 for conducting a signal from junction 326 to the magnetically-latched valve 8 (see FIG. 30).

Figure 32:
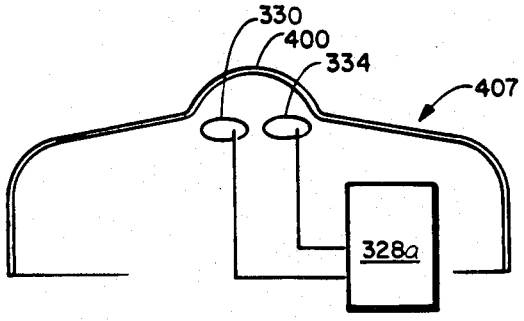
FIG. 32 is a schematic and side sectional view of a combustible gas sensor and indicator for use in detecting combustible gases which are lighter than air.

An alternative embodiment of the combustible gas sensor 325 is shown in FIG. 32. The sensor of FIG. 32 senses the presence of gases, such as methane, which are lighter than air. To accomplish such detection, the thermistors, as described with respect to FIG. 29, specifically the catalytic-coated thermistor 324 and the noncatalytic-coated thermistor 330, are placed inside an inverted cup 400 placed in the apparatus cover 407. The thermistors are coupled to an electronic circuit 328 similar to that described with respect to FIG. 29.

Figure 31:
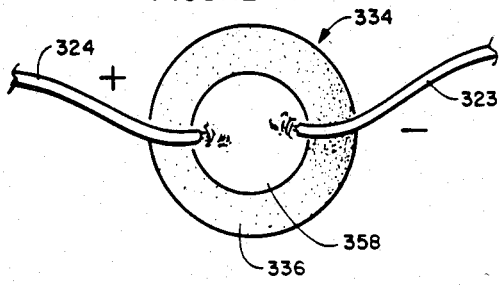
FIG. 31 is a schematic view of a catalytic thermistor for use in the combustible gas sensors of FIGS. 29 and 30.

The catalytic-coated thermistor 334 is shown in FIG. 31. The coated thermistor includes a thermistor 358, generally known in the art. The thermistor 358 is coated with a catalyst coating 336. The thermistor 358 includes a positive lead 324 and a negative lead 323, the connections for which are discussed below. The coated, but noncatalytic-coated, thermistor 330 has a coating 330a which has thermal properties identical to the thermal properties of the catalytic coating so that the only difference in function between the two thermistors is the effect produced by the catalyst.

To provide a thermally high sensitive device, the catalytic-coated thermistor is coated with a very active high-surface-area metal catalyst, such as platinum, rhodium, iridium, palladium, or any mixture or alloys of the above, metals, such as alloys of nickel, silver, and gold. Also, a mixture of metal salts, such as platinum, molybdenum, and copper, deposited on a high-surface-area material, such as alumina or silica, may be used.

Figure 30:
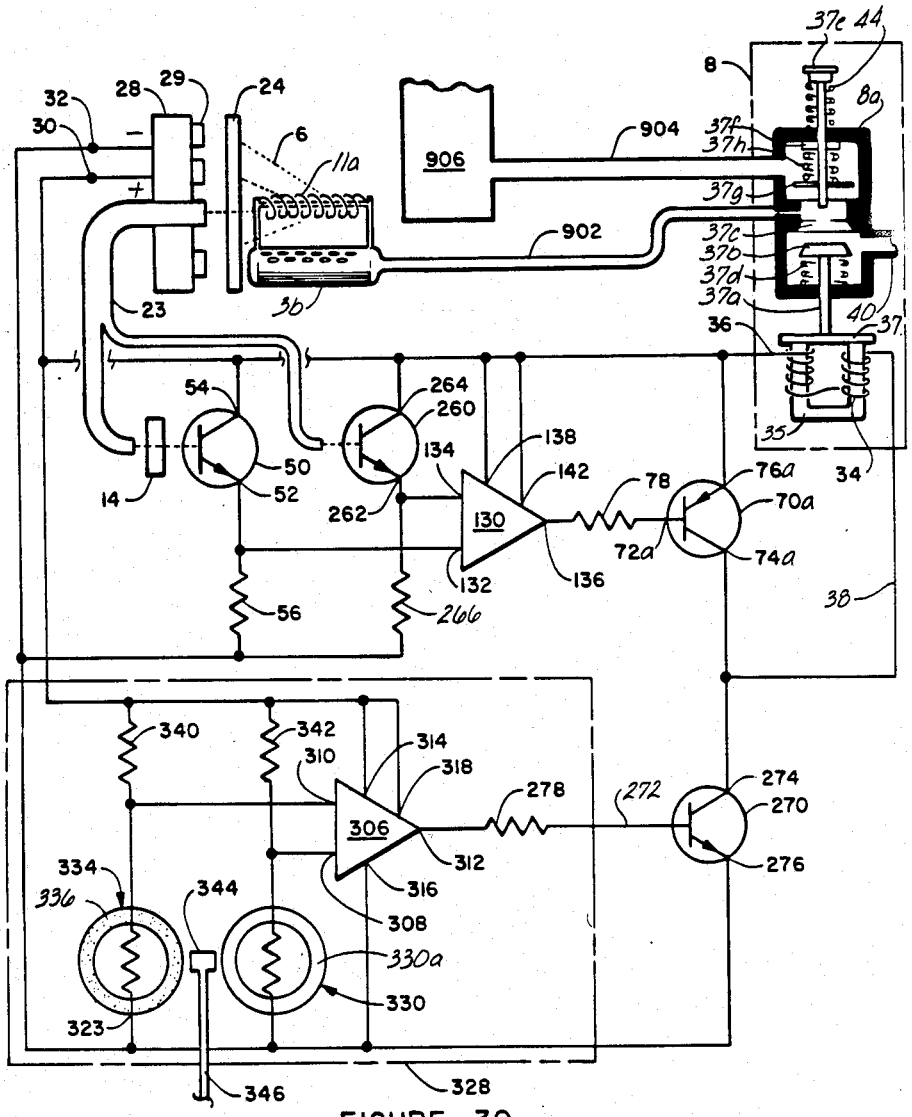
FIG. 30 is a schematic view showing the combustion device of FIG. 16 in combination with an electronic circuit for controlling the fuel control in conjunction with the combustible gas sensor of FIG. 29.

A combustible gas detection circuit 328 is shown in FIG. 30. This detection circuit includes a bridge or comparison circuit for indicating the presence of combustible gas and includes a pair of leads from the photovoltaic array 28. The apparatus and circuit shown in FIG. 30 is a modification of FIG. 16, with common elements numbered the same. The description of the structure and function of the common elements will be omitted.

A first resistor 340 is coupled at one end to the positive lead 30 of the photovoltaic array 28 and coupled at the other end through the catalytic-coated thermistor 334 to the negative lead 32 of the photovoltaic array 28. A second resistor 342 is coupled to the positive lead 30 and also at its opposite lead to the negative conductor 32 of the photovoltaic array 28 through the noncatalytic-coated thermistor 330. An operational amplifier 306 is provided in the gas detection circuit 328 with its positive sensing input 310 coupled between the first resistor 340 and the catalytic-coated thermistor 334. The negative sensing input 308 of op amp 306 is coupled between the second resistor 342 and the noncatalytic-coated thermistor 330. The positive op amp power supply 314 is coupled to the positive lead 30, as is the bias select input 318 of op amp 306. The negative power supply input 316 is coupled to the negative lead 32 of the photovoltaic array 28. The output 312 of op amp 306 is coupled through a resistor 278 to a series NPN transistor 270 at its base 272. The collector 274 is coupled to match the collector 74a of transistor 70a. The collector is also coupled to the negative lead 38 of the coil 34. The emitter 276 is coupled to the negative lead 32 of the photovoltaic array 28. The emitter 76*a* of transistor 70*a* is connected to the positive side 30 of photovoltaic array 28 and to one side 36 of coil 34.

The thermistors 330 and 334 are loosely thermally coupled to each other by means of a relatively poor heat conductor 344 and to a heat source (not shown) by means of a heat conductor 346 for maintaining the catalytic coating at its optimum operating temperature. A relatively poor heat conductor 344 is used so that, absent any combustible gases, the two thermistors will remain at the same temperature. The optimum temperature for the catalytic coating is determined by the catalyst used and by the gas to be sensed, if selectivity with respect to the gas is desired. For example, the optimum temperature for pure platinum for detecting methane is different from that for detecting propane. The heat source may be an electric heater, or the heat derived from the operation of the burner.

The operation of the combustible gas detection system sensor will be described with respect to FIGS. 29 and 30. However, it is to be understood that the operation of the combustible gas sensor is the same for the detection of gases lighter than air, for which the thermistors are placed in an inverted cup 400, as shown in FIG. 32.

The combustible gas detection circuit 328 is normally an unbalanced bridge circuit wherein the resistors 340 and 342 are chosen for providing the unbalanced circuit. The operational amplifier 306 functions as the bridge detector and provides the base current through resistor 278 to the base 272 of NPN transistor 270. When no combustible gases are present, the thermistors sense the ambient temperature through the respective coatings on the catalytic-coated thermistor 334 and the noncatalytic-coated thermistor 330. Current goes from the positive lead through the first resistor 340 to the catalytic-coated thermistor 334 and produces a potential at the positive sensing input 310 of op amp 306. Current also flows through the second resistor 342 through the noncatalytic-coated thermistor 330 and produces a second voltage at the negative sensing input 308 of the op amp. The first and second resistors 340 and 342, respectively, are chosen so that the potential at the positive sensing input of the op amp is greater than the potential at the negative sensing input. The output of the op amp is therefore in the high state, which causes current to flow through transistor 270.

If a fuel leak is present in the area of the combustible gas detection circuit 328, combustible gases which are heavier than air collect in the sump 38 and diffuse through apertures 325*b* to the interior of the detection chamber 325*c*. The catalyst coated on the catalytic-coated thermistor 334 will produce an exothermic reaction, which in turn reduces the resistance of thermistor 334, increasing the conduction therethrough. The potential at the positive sensing input of op amp 306 is thereby decreased. When the potential at the positive sensing input becomes less than that at the negative sensing input, the output of the op amp will change to the low state, shutting off the series switch transistor 270. The magnetic latch valve 8 is thereby closed. When the concentration of combustible gases decreases, the configuration of the electronic circuit will return to its original state, thereby allowing the valve 8 to be reopened.

Figure 33:
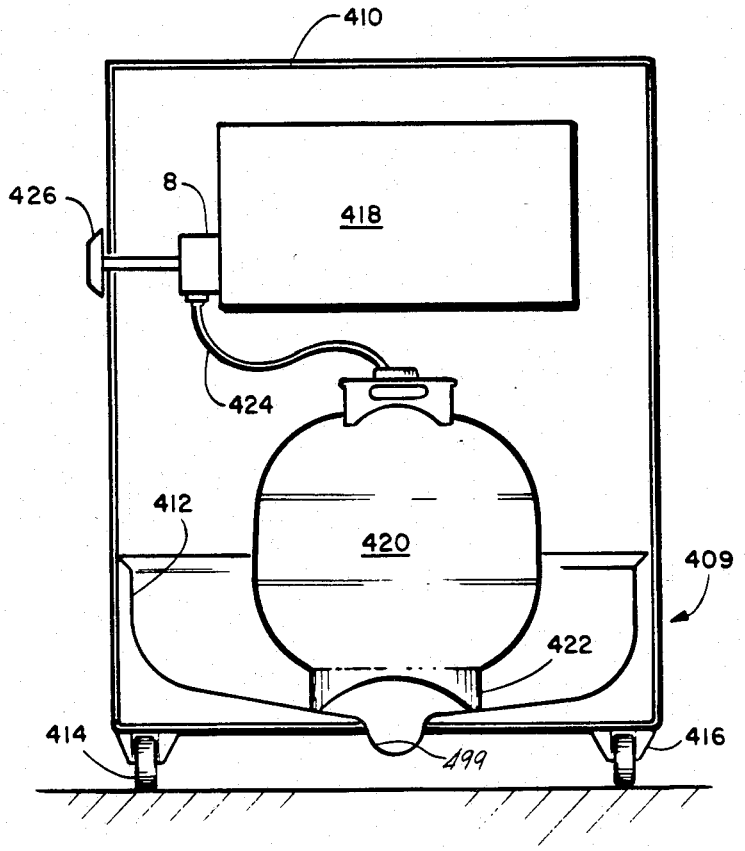
FIG. 33 is a schematic and side sectional view of an unvented combustion device including a heavier-than-air combustible gas sensor and safety shutoff system using the combustible gas sensor of FIGS. 29-31.

FIG. 33 depicts a portable heater 409 which contains a liquid propane bottle 420 set on a mount 422. The heater 409 may be easily moved on wheels 414 and 416. The heater may be controlled by turning control knob 426 for controlling the magnetic latched valve 8. The fuel contained in the bottle 420 is passed through the valve 8 to the combustion chamber 418. The combustion chamber is similar to those illustrated schematically in FIGS. 1 and 5. Unburned fuel escaping from a malfunctioning valve or from a leak, for example, will collect at the low point 499 due to gravity. The relative concentration of the leaking fuel will be increased due to the collection of the heavier-than-air gas in the low point 499. The collection surface 412 is sealed against the case 410 to ensure collection of tee heavier-than-air fuel. The photovoltaic control system 1 is connected to a safety circuit, as described with respect to FIG. 30 and will shut off the burner upon sensing combustible gas, carbon monoxide, or flame-out.

The Shuler CO sensor array includes palladium sulfate and ammonium molybdate absorbed on silica gel. A salt of a transition metal such as copper, iron or nickel is included so that the sensor can be regenerated. The sensor may include the metal ion of tungsten or vanadium instead of ammonium molybdate.

It should be noted that the above are preferred configurations, but others are foreseeable. The described embodiments of the invention are only considered to be preferred and illustrative of the inventive concepts. The scope of the invention is not to be restricted to such embodiment. Various and numerous other arrangements may be devised by one skilled in the art without departing from the spirit and scope of the invention.

What is claimed is:

1. Self-contained apparatus for controlling burning of a fuel in a burner comprising:
   - a burner;
   - controller means for controlling burning of fuel in the burner;
   - an emissive surface heated by burning of fuel in the burner; and
   - photovoltaic means connected to the controller means for receiving electromagnetic radiation from the emissive surface and for generating sufficient electric current and voltage from such radiation for operating the controller means with no other source of electric power.

2. Apparatus as recited in claim 1 wherein the controller means comprises a valve for delivering or interrupting fuel flow to the burner, and means for closing the valve in the event the electric current decreases below a predetermined magnitude.

3. Apparatus as recited in claim 2 wherein the burner comprises a main burner and a pilot burner and wherein the emissive surface is in the pilot burner flame, and the valve interrupts fuel flow to both the pilot burner and main burner.

4. Apparatus as recited in claim 1 further comprising a blower for delivering air to the burner and wherein the emissive surface and photovoltaic means can generate sufficient power for operating the blower with no other source of electric power.

5. Apparatus as recited in claim 1 wherein the emissive surface comprises a material for emitting radiation in a narrower band than black body radiation.

6. Apparatus as recited in claim 1 wherein the emissive surface comprises a thermally stiumlated quantum emitter.

7. Apparatus as recited in claim 6 wherein the quantum emitter comprises at least one oxide of a metal from the group consisting of the rare earth metals.

8. Apparatus as recited in claim 1 wherein the emissive surface comprises a material for emitting radiation having a characteristic wavelength similar to the characteristic spectral response of the photovoltaic means.

9. Apparatus as recited in claim 1 further comprises a filter between the emissive surface and the photovoltaic means for absorbing at least a portion of the radiation from the emissive surface.

10. Apparatus as recited in claim 1 wherein the burner comprises a porous surface combustion burner and the emissive surface comprises a surface portion of the burner.

11. Apparatus as recited in claim 10 wherein the surface of the burner comprises a thermally stimulated quantum emitter.

12. Apparatus as recited in claim 1 wherein the emissive surface comprises a wire mesh.

13. Apparatus as recited in claim 12 wherein the wire mesh comprises a nickel-chromium alloy.

14. Apparatus as recited in claim 12 wherein the wire mesh supports a thermally stimulated quantum emitter.

15. Apparatus as recited in claim 1 wherein the photovoltaic means comprises a material selected from the group consisting of copper indium diselenide and indium gallium arsenide.

16. Apparatus as recited in claim 1 wherein the controller comprises:

a valve for permitting or interrupting fuel flow to the burner;

a photosensor;

a gas sensor in the path of electromagnetic radiation between the emissive surface and the photosensor, the gas sensor changing its transparency to electromagnetic radiation in response to concentration of a target gas; and means for connecting the photosensor with the valve for interrupting fuel flow when electromagnetic radiation reaching the photosensor decreases below a predetermined magnitude.

17. Apparatus as recited in claim 1 wherein the controller regulates the ratio of fuel and air at the burner.

18. A high-speed, self-powered safety shutoff for a gas appliance comprising:

a main burner;

a pilot burner for igniting the main burner;

a valve for permitting or interrupting gas flow to the pilot burner and main burner;

electromagnetic means for temporarily latching the valve in its open position;

an emissive surface in the flame of the pilot burner;

photovoltaic means coupled directly to the electromagnetic means for receiving radiation from the emissive surface and generating sufficient electric power for maintaining the valve in its open position with no other source of electric power; and means for biasing the valve toward its closed position when electric power from the photovoltaic means decreases below a predetermined magnitude.

19. Apparatus as recited in claim 18 wherein the emissive surface comprises a wire mesh.

20. Apparatus as recited in claim 19 wherein the wire comprises a nickel-chromium alloy.

21. Apparatus as recited in claim 17 wherein the wire mesh supports a thermally stimulated quantum emitter.

22. A self-powered control system for a fuel burning apparatus:

a porous surface combustion burner;

fuel control means for delivering fuel to the porous surface combustion burner;

a blower for delivering air to the porous surface combustion burner; and photovoltaic means connected to the fuel control means and the blower for receiving electromagnetic radiation from the surface of the porous surface combustion burner and producing sufficient electric current and voltage for operating the fuel control means and the blower with no other source of electric power.

23. A system as recited in claim 22 wherein the porous system combustion burner includes a thermally stimulated quantum emitter at least on its outer surface.

24. A system as recited in claim 23 wherein the quantum emitter comprises at least one oxide of a rare earth metal.

25. An apparatus for producing electric power for self powering a fuel burning heating device without an outside source of electricity, the apparatus characterized by fuel valve means for delivering fuel to a pilot flame of a hearing device;

an emissive surface in the pilot flame of the heating device;

photovoltaic means connected to the fuel valve means for receiving electromagnetic radiation produced from the emissive surface when heated and for producing electric current and voltage having a sufficient electric power magnitude from the electromagnetic radiation from the emissive surface for maintaining the fuel valve means in an open position and for interrupting fuel flow when the electric power magnitude decreases.

* * * * *

UNITED STATES PATENT AND TRADEMARK OFFICE

CERTIFICATE OF CORRECTION

PATENT NO. : 4,793,799

DATED : December 27, 1988

INVENTOR(S) : Mark K. Goldstein; Earl M. Dolnick

It is certified that error appears in the above-identified patent and that said Letters Patent is hereby corrected as shown below:

In the Specification:

| | |
|---|---|
| Column 1<br>Line 66 | Change "4,405,299" to -- 4,505,299 --. |
| Column 4<br>Line 44 | Change "batter" to -- battery --. |
| Column 4<br>Line 58 | Change "tee" to -- the --. |
| Column 4<br>Line 59 | Change "o" to -- of --. |
| Column 4<br>Line 67 | Change "C" to -- CO --. |
| Column 5<br>Line 32 | Change "FIG., 1" to -- FIG. 1 --. |
| Column 5<br>Line 61 | Change "add" to -- and --. |
| Column 7<br>Line 1 | Change "Tee" to -- The --. |
| Column 7<br>Line 37 | After "occurs" insert a period. |
| Column 8<br>Line 41 | Change "require" to -- required --. |

UNITED STATES PATENT AND TRADEMARK OFFICE

CERTIFICATE OF CORRECTION

PATENT NO. : 4,793,799

DATED : December 27, 1988

INVENTOR(S) : Mark K. Goldstein; Earl M. Dolnick

It is certified that error appears in the above-identified patent and that said Letters Patent is hereby corrected as shown below:

| | |
|---|---|
| Column 8<br>Line 58 | After "diselenide" insert a period. |
| Column 9<br>Line 3 | Change "element" to -- elements --. |
| Column 14<br>Line 27 | Change "ear" to -- near --. |
| Column 15<br>Line 43 | Change "22" to -- 122 --. |
| Column 18<br>Line 3 | Change "70" to -- 170 --. |
| Column 18<br>Line 25 | Change "18" to -- 178 --. |
| Column 20<br>Line 31 | Change "o" to -- of --. |
| Column 21<br>Line 29 | Change "descried" to -- described --. |
| Column 22<br>Line 47 | Change "200" to -- 210 --. |
| Column 22<br>Line 65 | Change "s" to -- as --. |
| Column 23<br>Line 44 | Change "bas" to -- base --. |

UNITED STATES PATENT AND TRADEMARK OFFICE

CERTIFICATE OF CORRECTION

PATENT NO. : 4,793,799

DATED : December 27, 1988

INVENTOR(S) : Mark K. Goldstein; Earl M. Dolnick

It is certified that error appears in the above-identified patent and that said Letters Patent is hereby corrected as shown below:

| | |
|---|---|
| Column 24<br>Line 34 | After "volt" insert a period. |
| Column 27<br>Line 25 | Change "an" to -- and --. |
| Column 27<br>Line 36 | Change "helmium" to -- holmium --. |
| Column 27<br>Line 39 | Change "photovoltiic" to<br>-- photovoltaic --. |
| Column 29<br>Line 32 | Change "emission ,The" to -- emission. The --. |
| Column 29<br>Line 50 | Change "are.." to -- area. --. |
| Column 29<br>Line 54 | Change "diskshaped" to -- disk-shaped --. |
| Column 29<br>Line 55 | Change "300" to -- 320 --. |
| Column 30<br>Line 5 | After "324b" insert a period. |
| Column 30<br>Line 5 | Change "226" to -- 326 --. |
| Column 31<br>Line 50 | Change "38" to -- 338 --. |

UNITED STATES PATENT AND TRADEMARK OFFICE

CERTIFICATE OF CORRECTION

PATENT NO. : 4,793,799

DATED : December 27, 1988

INVENTOR(S) : Mark K. Goldstein; Earl M. Dolnick

It is certified that error appears in the above-identified patent and that said Letters Patent is hereby corrected as shown below:

Column 32 Line 12 — Change "tee" to -- the --.

In the Claims:

Column 34 Line 30 — Change "system" to -- surface --.

Column 34 Line 40 — Change "hearing" to -- heating --.

Column 34 Line 50 — After "position" insert -- with no other source of electric power --.

Signed and Sealed this

Twenty-ninth Day of August, 1989

*Attest:*

*Attesting Officer*

DONALD J. QUIGG

*Commissioner of Patents and Trademarks*